US007180829B2

(12) United States Patent
Watanabe

(10) Patent No.: US 7,180,829 B2
(45) Date of Patent: Feb. 20, 2007

(54) TIMEPIECE EQUIPPED WITH CALENDAR MECHANISM INCLUDING FIRST AND SECOND DATE INDICATORS

(75) Inventor: Mamaru Watanabe, Chiba (JP)

(73) Assignee: Seiko Instruments Inc. (JP)

( * ) Notice: Subject to any disclaimer, the term of this patent is extended or adjusted under 35 U.S.C. 154(b) by 88 days.

(21) Appl. No.: 11/045,970

(22) Filed: Jan. 28, 2005

(65) Prior Publication Data

US 2005/0169109 A1 Aug. 4, 2005

(30) Foreign Application Priority Data

Jan. 30, 2004 (JP) ..... 2004-023149

(51) Int. Cl.
*G04B 19/20* (2006.01)

(52) U.S. Cl. ..... 368/37; 368/38

(58) Field of Classification Search ..... 368/28, 368/34–38

See application file for complete search history.

(56) References Cited

U.S. PATENT DOCUMENTS 4,257,113 A * 3/1981 Meister et al. ..... 368/35
6,081,483 A * 6/2000 Capt et al. ..... 368/28
7,023,762 B1 * 4/2006 Burkhardt et al. ..... 368/35
2002/0080687 A1 * 6/2002 Rochat et al. ..... 368/37
2003/0103417 A1 * 6/2003 Gabathuler et al. ..... 368/37
2005/0169108 A1 * 8/2005 Watanabe ..... 368/37

FOREIGN PATENT DOCUMENTS

EP 001460494 A1 * 9/2004
JP 3390021 8/2000
JP 00314779 11/2000

* cited by examiner

*Primary Examiner*—Judy Nguyen
*Assistant Examiner*—Leo T. Hinze
(74) *Attorney, Agent, or Firm*—Adams & Wilks

(57) ABSTRACT

A timepiece equipped with a calendar mechanism has a first date indicator for displaying the units numeral of the date, a first date jumper for setting a position of the first date indicator in a rotation direction, a second date indicator for displaying the tens numeral of the date, a second date jumper for setting a position of the second date indicator in a rotation direction, and a date intermediate wheel for undergoing rotation in accordance with rotation of the first date indicator to thereby rotate the second date indicator. The first date indicator has a first date character display surface including 31 numerals "1", "1", "2", "3", "4", "5", "6", "7", "8", "9", "0", "1", "2", "3", "4", "5", "6", "7", "8", "9", "0", "1", "2", "3", "4", "5", "6", "7", "8", "9", and "0". The second date indicator has a first date character display surface including four numerals "1", "2", "3", and "0", or a second date character display surface including three numerals "1", "2", and "3".

6 Claims, 21 Drawing Sheets

TIMEPIECE EQUIPPED WITH CALENDAR MECHANISM INCLUDING FIRST AND SECOND DATE INDICATORS

BACKGROUND OF THE INVENTION

1. Field of the Invention

The present invention relates to a timepiece equipped with a calendar mechanism including a first date indicator for displaying the ones digit of the date and a second date indicator for displaying the tens digit of the date.

2. Description of the Prior Art

Generally, the mechanical body of a timepiece including the drive portion of the timepiece is referred to as the "movement". A dial and hands are attached to the movement and put into a timepiece case, forming a complete product. This state is referred to as the "completed" state of the timepiece. A main plate forms the base plate of the timepiece. The side of the main plate which faces the timepiece case glass or on the side of the dial is referred to as the "back side", "glass side", or "dial side" of the movement. The other side of the main plate which faces a case back of the timepiece (i.e., which faces away from the dial) is referred to as the "front side" or "case back side" of the movement. A train wheel incorporated into the "front side" of the movement is referred to as the "front train wheel". A train wheel incorporated into the "back side" of the movement is referred to as the "back train wheel".

Hereunder, it is explained about a constitution of the timepiece with the calendar mechanism containing the 1st date indicator displaying the place of units among dates, and the 2nd date indicator displaying the place of tens among dates.

(1) Timepiece with Conventional 1st Type Calendar Mechanism

A timepiece with a conventional 1st type calendar mechanism possesses a dial having a large window, and a rotating body (i.e., 1st date indicator) for the place of units in which there are disposed 31 numerals containing one numeral of "1" and 3 sets of numerals of "1" to "9" and "0" and there are provided 4 teeth, and additionally possesses a star-shaped plate for the place of tens having 4 teeth, and a rotating body (i.e., 2nd date indicator) for the place of tens in which there are disposed numerals of "0", "1", "2", "3". The rotating body (i.e., 1st date indicator) for the place of units is directly rotating the rotating body (i.e., 2nd date indicator) for the place of tens (for example, refer to Japanese Patent No. 3390021 Gazette).

(2) Timepiece with Conventional 2nd Type Calendar Mechanism

A timepiece with a conventional 2nd type calendar mechanism contains a 1st date plate (i.e., 1st date indicator) displaying the place of units of dates, a 2nd date plate (i.e., 2nd date indicator) displaying the place of tens of dates, a date unlocking wheel driving the 1st date plate, an unlocking pawl provided in the 1st date plate, an intermediate wheel driven by the unlocking pawl, a 1st jumping control lever rotating the 1st date plate from an unlocking midway and causing it to remain in a stabilized position, and a 2nd jumping control lever rotating the 2nd date plate from the unlocking midway and causing it to remain in a stabilized position. In the 1st date plate (i.e., 1st date indicator), there are disposed 20 numerals containing two sets of numerals of "1" to "9" and "0" (for example, refer to JP-A-2000-314779 Gazette).

(3) List of Patent Documents

Hereunder, there is shown a list of the Patent Documents relating to the timepiece with the conventional calendar mechanism mentioned above.

(1) Problems of Timepiece with Conventional 1st Type Calendar Mechanism

Since the timepiece with the conventional 1st type calendar mechanism possesses the rotating body for the place of units in which there are disposed 31 numerals containing numeral of "1" and 3 sets of numerals of "1" to "9" and "0", a time at which the calendar mechanism must be corrected at the end of the month is respectively the end of February, April, June, September and November. That is, the number of times at which the calendar mechanism must be corrected is 5 times per year. However, in the timepiece with the conventional 1st type calendar mechanism, since the rotating body for the place of units directly rotates the rotating body for the place of tens, it has been impossible to dispose such that the rotating body for the place of units and the rotating body for the place of tens have the same rotation center. Accordingly, in this structure, when designing the two rotating bodies, there has been generated a restriction in a position where the date can be displayed by the 2 rotating bodies.

(2) Problems of Timepiece with Conventional 2nd Type Calendar Mechanism

In the timepiece with the conventional 2nd type calendar mechanism, in the 1st date plate, there are disposed two sets of numerals of "0" and "1"–"9", i.e., 20 numerals. Accordingly, the time at which the calendar mechanism must be corrected at the end of the month is respectively the end of every month. That is, the number of times at which the calendar mechanism must be corrected is 12 times per year.

SUMMARY OF THE INVENTION

An object of the present invention is to provide a timepiece equipped with a calendar which does not increase the number of times at which the calendar mechanism must be corrected at the end of the month and whose operation property is good, the timepiece equipped with the calendar mechanism including a first date indicator for displaying the ones digits of the date and a second date indicator for displaying the tens digits of the date.

Further, another object of the present invention is to provide a timepiece equipped with a calendar mechanism in which the restriction in design is minimized by disposing the rotation center of the first date indicator and the rotation center of the second date indicator in the same position.

The present invention is constituted such that, in a timepiece with a calendar mechanism containing 2 date indicators, it possesses a 1st date indicator displaying a place of units among dates, a 1st date jumper for setting a position of the 1st date indicator in a rotation direction, a 2nd date indicator displaying a place of tens among dates, a 2nd date jumper for setting a position of the 2nd date indicator in a rotation direction, and a date intermediate wheel which rotates on the basis of a rotation of the 1st date indicator, thereby being capable of rotating the 2nd date indicator. In this timepiece with a calendar mechanism, it is characterized in that the 1st date indicator has a 1st date letter display face containing 31 numerals of "1", "1", "2", "3", "4", "5", "6", "7", "8", "9", "0", "1", "2", "4", "5", "6", "7", "8", "9", "0", "1", "2", "3", "4", "5", "6", "7", "8", "9", "0" and the 2nd date indicator has a 1st date letter display face containing numerals of "1", "2", "3", "0", or a 2nd date letter display face containing numerals of "1", "2", "3". By this constitution, it is possible to realize a timepiece with a calendar mechanism, which does not increase the number of times at which the calendar mechanism must be corrected in the end of the month, and whose operation property is good.

In a timepiece with a calendar mechanism of the present invention, it is desirable that a rotation center of the 1st date indicator and a rotation center of the 2nd date indicator are disposed so as to exist in the same position. By this constitution, it is possible to realize a timepiece with a calendar mechanism, in which the restriction in design is small.

Additionally, in a timepiece with a calendar mechanism of the present invention, it is desirable that the 2nd date letter display face is disposed in a position nearer to a dial than the 1st date letter display face. By this constitution, it is possible to realize a timepiece with a calendar mechanism, whose date display is easy to see and in which the restriction in design is small.

Additionally, in a timepiece with a calendar mechanism of the present invention, it is desirable that it is constituted such that the 1st date indicator contains 31 1st date indicator teeth parts formed as internal teeth and 4 calendar shift teeth formed as internal teeth, the 1st date indicator teeth parts are formed with a spacing of equal angle, the calendar shift teeth comprise a 1st calendar shift tooth becoming a reference, a 2nd calendar shift tooth formed with a spacing of (360×2/31) degrees in a 1st direction (for example, clockwise direction) with the 1st calendar shift tooth being made the reference, a 3rd calendar shift tooth formed with a spacing of (360×10/31) degrees in the 1st direction (for example, clockwise direction) with the 2nd calendar shift tooth being made a reference, and a 4th calendar shift tooth formed with a spacing of (360×9/31) degrees in a 2nd direction opposite to the 1st direction (for example, counterclockwise direction) with the 1st calendar shift tooth being made the reference, and the date intermediate wheel rotates by the fact that the calendar shift teeth of the 1st date indicator rotate, thereby rotating the 2nd date indicator.

Additionally, in a timepiece with a calendar mechanism of the present invention, it is desirable that the 2nd date indicator possesses a disc-shaped 2nd date letter display face provided with notches, the 2nd date letter display face contains 12 trapezoid portions formed with a spacing of (360/12) degrees and 12 notch parts formed with the spacing of (360/12) degrees, and in the 2nd date letter display face there are provided sets of numerals consisting of numeral of "1", numeral of "2", numeral of "3" and numeral of "0" by 4 sets.

Additionally, in a timepiece with a calendar mechanism of the present invention, it is desirable that it is constituted such that the 2nd date indicator contains 12 positioning teeth parts formed as external teeth and 12 unlocking teeth formed as external teeth, the positioning teeth parts are formed with a spacing of equal angle, the unlocking teeth are formed with the spacing of equal angle, the positioning teeth parts are set by the 2nd date jumper, and the date intermediate wheel meshes with the unlocking teeth. By this constitution, it is possible to realize a timepiece with a calendar mechanism, which is small and thin and in which the restriction in design is small.

BRIEF DESCRIPTION OF THE SEVERAL VIEWS OF THE DRAWINGS

A preferred form of the present invention is illustrated in the accompanying drawings in which.

DETAILED DESCRIPTION OF THE PREFERRED EMBODIMENTS

Figure 1:
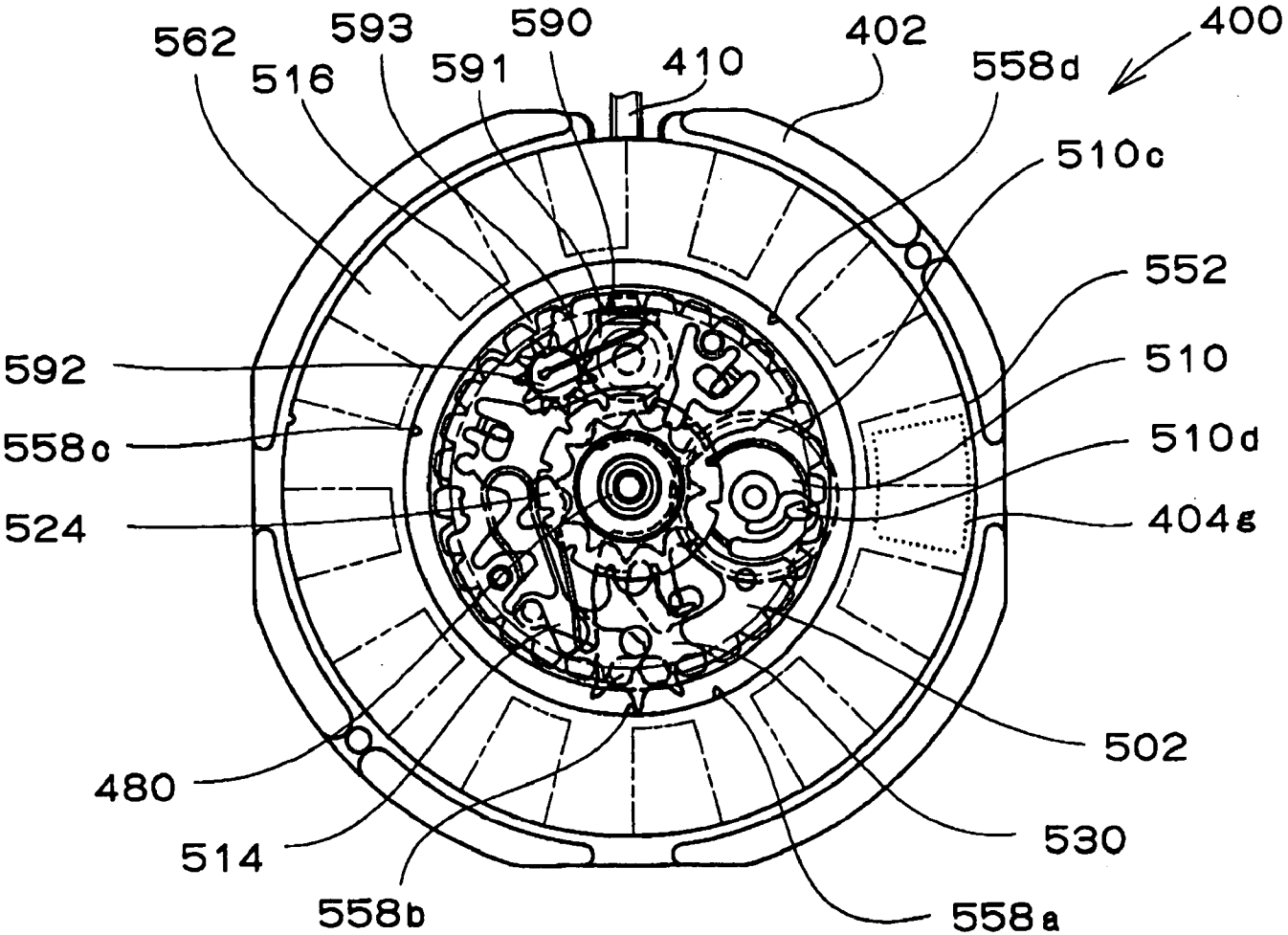
FIG. 1 is a schematic plan view showing a structure when a movement is seen from a dial side in a 1st embodiment of a timepiece with a calendar mechanism of the present invention.

Hereunder, embodiments of a timepiece with a calendar mechanism of the present invention are explained on the basis of the drawings.

(1) Structure of 1st Embodiment of Timepiece with Calendar Mechanism of the Present Invention First, it is explained about a 1st embodiment of a timepiece with a calendar mechanism of the present invention.

(1.1) Whole Constitution of Movement

Referring to FIG. 1–FIG. 3 and FIG. 19, in the 1st embodiment of the timepiece with the calendar mechanism of the present invention, a movement 400 is constituted by an analog electronic timepiece. The movement 400 contains a main plate 402 constituting a base plate of the movement 400, and a date indicator maintaining plate 502. A dial 404 is attached to the movement 400. The dial 404 is attached to the glass side of the movement 400. In the movement 400, the "front side" denotes a side remote from the dial 404 between both sides of the main plate 402, i.e., the "case back side". In the movement 400, the "back side" denotes a side near to the dial 404 between both sides of the main plate 402, i.e., the "dial side". The date indicator maintaining plate 502 is disposed in the "back side" in the movement 400. A winding stem 410 is rotatably incorporated into the main plate 402. A clutch 472 is disposed so as to have the same rotation axis as a rotation axis of the winding stem 410. A rocking device/second setting device contains the winding stem 410, a train wheel setting lever 468, and a winding stem positioning part 662*f* of a battery plus terminal 662. The rocking device is disposed in the "front side" in the movement 400. It is also possible to dispose the rocking device in the "rear side" in the movement 400.

(1.2) Constitution of Front Side of Movement

Figure 2:
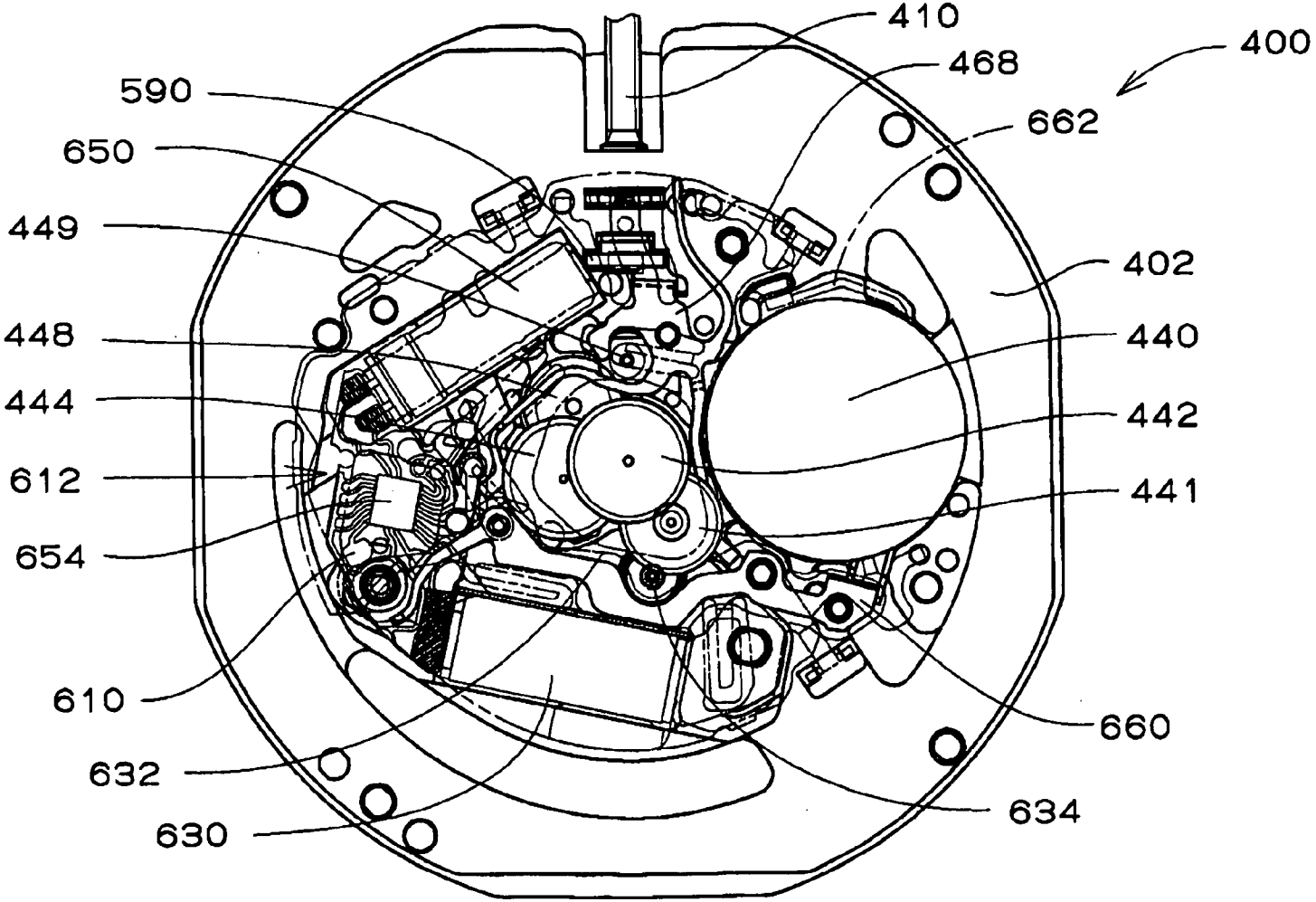
FIG. 2 is a schematic plan view showing the structure when the movement is seen from a case back side in the 1st embodiment of the timepiece with the calendar mechanism of the present invention.
Figure 3:
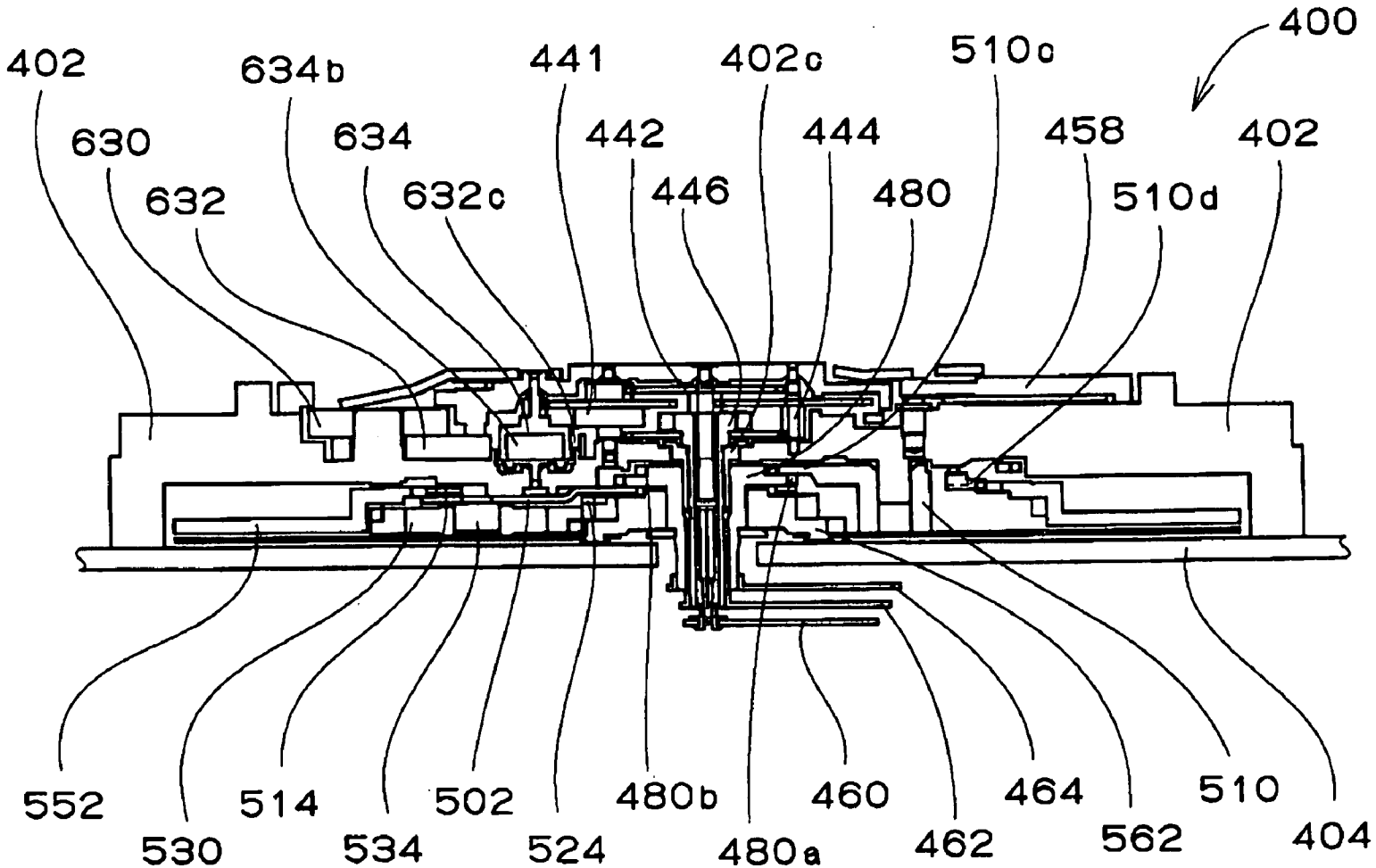
FIG. 3 is a partial sectional view showing a front train wheel and one portion of the calendar mechanism in the 1st embodiment of the timepiece with the calendar mechanism of the present invention.
Figure 18:
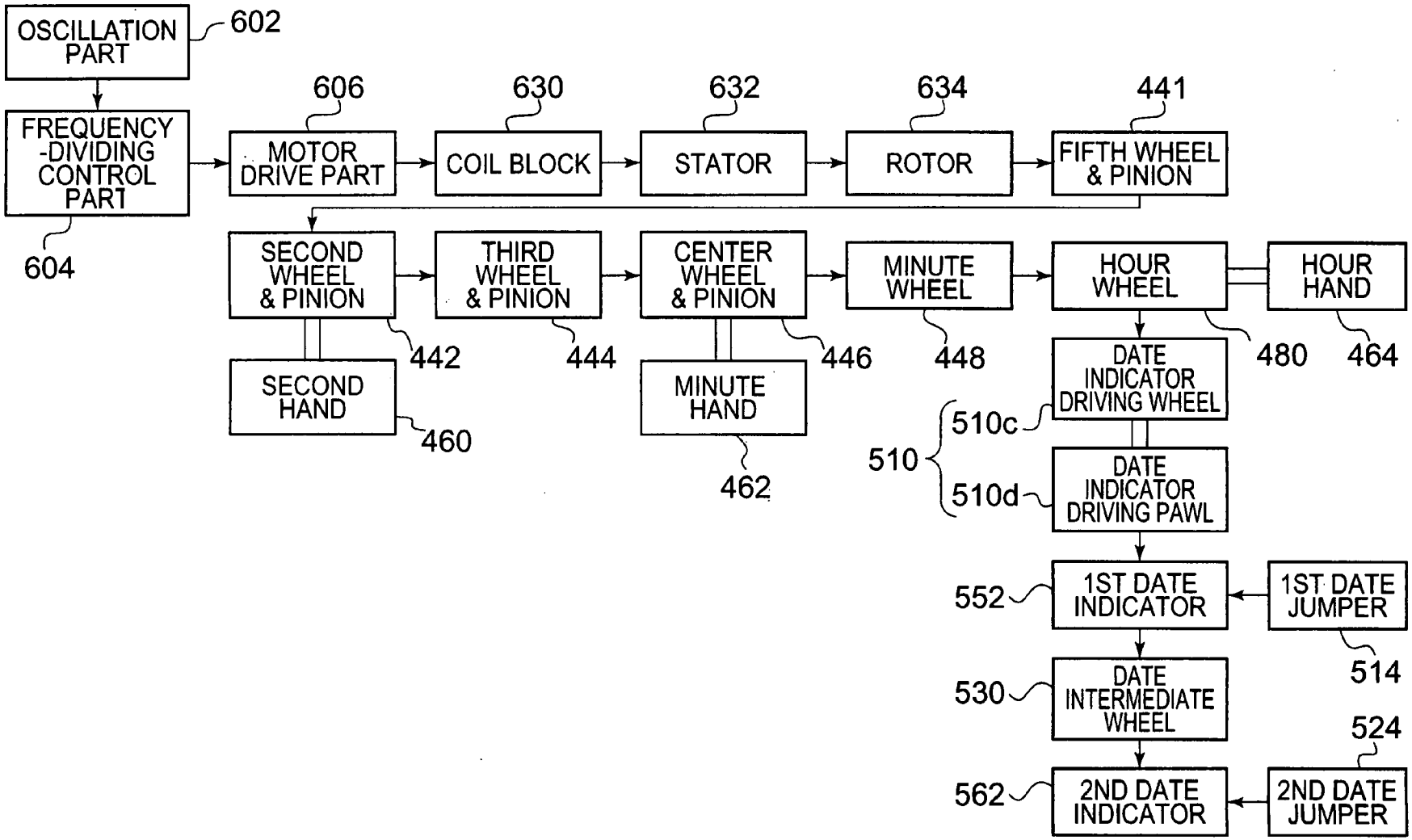
FIG. 18 is a block diagram showing a drive circuit, the front train wheel, the calendar mechanism, and the like in the 1st embodiment of the timepiece with the calendar mechanism of the present invention.

Hereunder, it is explained about a constitution of the front side of the movement. Referring to FIG. 2, FIG. 3, and FIG. 18, in the movement 400, a battery 440 constituting a power source of the timepiece is disposed in the case back side (front side) of the main plate 402. A crystal oscillator unit 650 constituting an oscillation source of the timepiece is disposed in the back case side of the main plate 402. A crystal oscillator oscillating at 32,768 Hertz for instance is accommodated in the crystal oscillator unit 650. In an integrated circuit (IC) 654, there are built in an oscillation part (oscillator) 602 outputting a reference signal on the basis of an oscillation of the crystal oscillator, a frequency-dividing control part 604 which frequency-divides an output signal of the oscillation part 602 to thereby perform a control of an operation of a step motor, and a motor drive part (driver) 606 outputting a motor drive signal driving the step motor on the basis of the output signal of the frequency-dividing control part 604. The integrated circuit 654 is constituted by a C-MOS or a PLA for instance. In a case where the integrated circuit 654 is constituted by the C-MOS, in the integrated circuit 654, there are built in the oscillation part 602, the frequency-dividing control part 604, and the motor drive part 606. In a case where the integrated circuit (IC) 654 is constituted by the PLA, it is constituted such that the oscillation part 602, the frequency-dividing control part 604 and the motor drive part 606 are operated by a program stored in the PLA.

The crystal oscillator unit 650 and the integrated circuit 654 are fixed to a circuit base plate 610. The circuit base plate 610, the crystal oscillator unit 650 and the integrated circuit 654 constitute a circuit block 612. The circuit block 612 is disposed in the case back side of the main plate 402. Additionally, in the timepiece with a calendar of the present invention, in compliance with a necessity, it is possible to use an externally attached element such as resistance, capacitor, coil and diode. A battery minus terminal 660 is provided for conducting a negative electrode of the battery 440 and a minus pattern of the circuit base plate 610. A battery plus terminal 662 is provided for conducting a positive electrode of the battery 440 and a plus pattern of the circuit base plate 610. In the case back side of the main plate 402, there are disposed a coil block 630 containing a coil wire wound around a magnetic core, a stator 632 disposed so as to contact with both end parts of the magnetic core of the coil block 630, and a rotor 634 containing a rotor magnet 634*b* disposed in a rotor hole 632*c* of the stator 632. The coil block 630, the stator 632 and the rotor 634 constitute the step motor. It is constituted such that a fifth wheel & pinion 441 is rotated by a rotation of the rotor 634. It is constituted such that a second wheel & pinion 442 is rotated by a rotation of the fifth wheel & pinion 441. It is constituted such that a third wheel & pinion 444 is rotated by a rotation of the second wheel & pinion 442. It is constituted such that a center wheel & pinion 446 is rotated by a rotation of the third wheel & pinion 444. It is constituted such that a minute wheel 448 is rotated by a rotation of the center wheel & pinion 446. It is constituted such that an hour wheel 480 is rotated by a rotation of the minute wheel 448.

The second wheel & pinion 442 is constituted so as to perform one rotation in one minute. A second hand 460 is attached to the second wheel & pinion 442. The center wheel & pinion 446 is constituted so as to perform one rotation in one hour. A minute hand 462 is attached to the center wheel & pinion 446. A slip mechanism is provided in the center wheel & pinion 446. When correcting the hands, the minute hand 462 and an hour hand 464 can be rotated by rotating the winding stem 410 under a state that the second hand 460 is stopped by the slip mechanism. The train wheel setting lever 468 is provided in order to stop a rotation of the second hand 460 by setting a gear wheel part of the fifth wheel & and pinion 441 when correcting the hands by pulling out the winding stem 410 to its 2nd stage. A center pipe 402*c* is fixed to the main plate 402. The center pipe 402*c* extends from the case back side of the main plate 402 to the dial side of the main plate 402. The center wheel & and pinion 446 is rotatably supported in a hole part of the center pipe 402*c*. An abacus bead of the second wheel & pinion 442 is rotatably supported in a hole part of the center wheel & pinion 446. A train wheel bridge 458 is disposed in the case back side of the main plate 402. An upper axle part of the rotor 634, an upper axle part of the fifth wheel & pinion 441, an upper axle part of the second wheel & pinion 442, an upper axle part of the third wheel & pinion 444 and an upper axle part of the minute wheel 448 are rotatably supported by the train wheel bridge 458. A lower axle part of the rotor 634, a lower axle part of the fifth wheel & pinion 441, a lower axle part of the third wheel & pinion 444 and a lower axle part of the minute wheel 448 are rotatably supported by the main plate 402.

(1.3) Constitution of Hour Display Train Wheel

Hereunder, it is explained about a constitution of an hour display train wheel. Referring to FIG. 1, FIG. 3 and FIG. 18, in the movement 400, the hour wheel 480 contains an hour gear wheel 480*a* and a date unlocking gear wheel 480*b*. The hour wheel 480 is constituted so as to perform one rotation in 12 hours. The hour hand 464 is attached to the hour wheel 480. By the hour hand 464 attached to the hour wheel 480, a "time" is displayed by a "12-hour system" in which one revolution becomes 12 hours.

(1.4) Constitutions of Rocking Mechanism and Hand Correcting Mechanism

Figure 19:
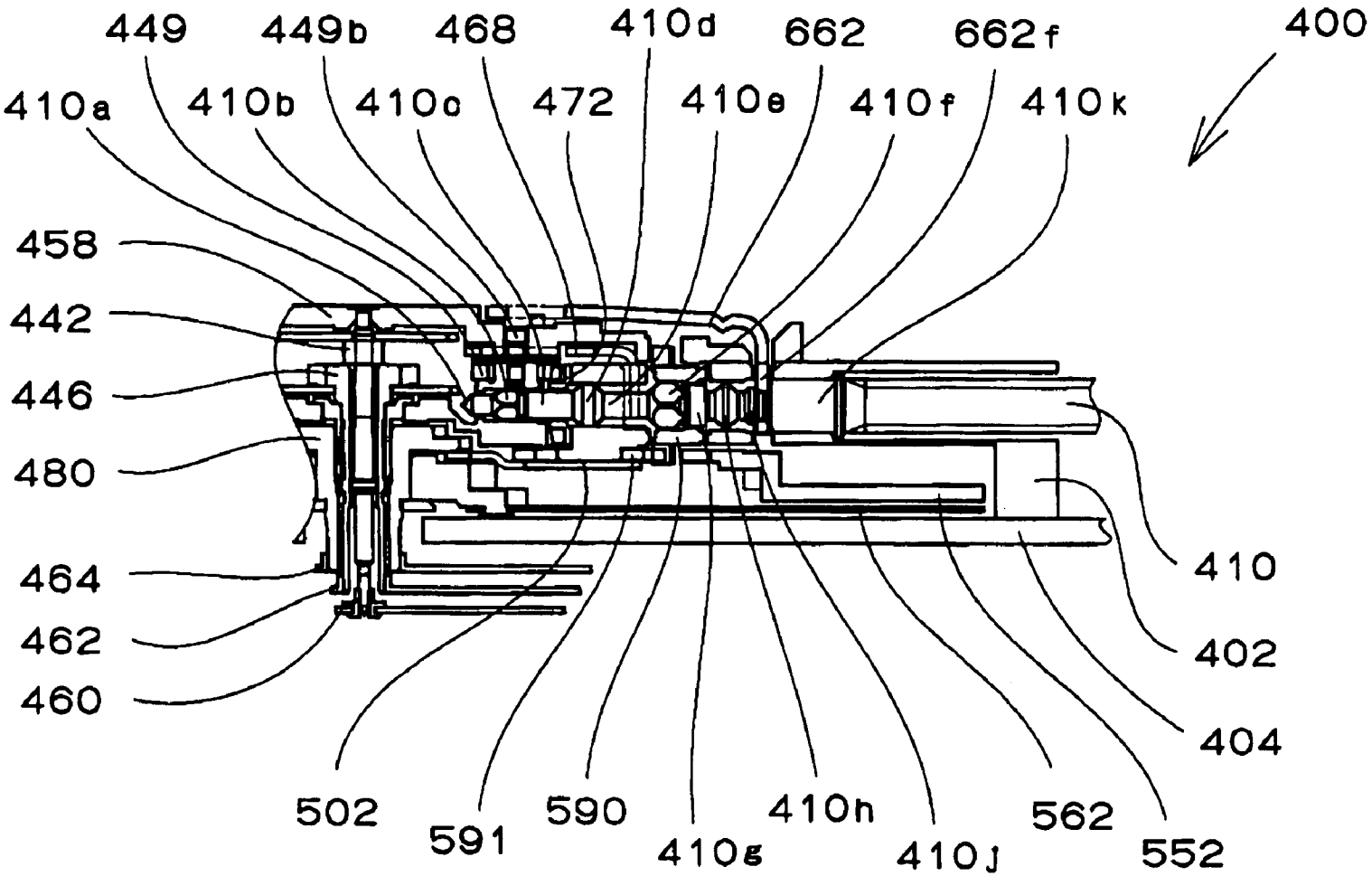
FIG. 19 is a partial sectional view showing portions of a winding stem, a setting wheel, and a center wheel & pinion in the 1st embodiment of the timepiece with the calendar mechanism of the present invention.

Hereunder, it is explained about constitutions of a rocking mechanism and a hand correcting mechanism. Referring to FIG. 2 and FIG. 19, in the movement 400, the winding stem 410 is rotatably incorporated into the main plate 402. The winding stem 410 contains a tip axle part 410*a*, a 1st angular part 410*b*, a 1st axle part 410*c*, a second setting operation axle part 410*d*, a 2nd axle part 410*e*, a 2nd angular part 410*f*, a 3rd axle part 410*g*, a 1st abacus bead part 410*h*, a 2nd abacus bead part 410*j* and a base axle part 410*k*, which have been formed from its tip side in order. The tip axle part 410*a* of the winding stem 410 is incorporated so as to be rotatable with respect to a winding stem tip hole of the main plate 402. The base axle part 410*k* of the winding stem 410 is incorporated so as to be rotatable with respect to a winding stem base hole of the main plate 402. It is good that an outer diameter of the 1st abacus bead part 410*h* is constituted so as to be larger than an outer diameter of the 2nd abacus bead part 410*j*.

A clutch 472 is disposed so as to have the same rotation axis as a rotation axis of the winding stem 410. It is constituted such that, when the winding stem 410 exists in its 0th stage and 1st stage, an interlock angular hole of the clutch wheel 472 is rotatable with respect to the 1st axle part 410*c* of the winding stem 410, and the clutch wheel 472 is not rotated even if the winding stem 410 is rotated. It is constituted such that, when the winding stem 410 exists in its 2nd stage, the interlock angular hole of the clutch wheel 472 fits with the 1st angular part 410*b* of the winding stem 410, and the clutch wheel 472 is rotated on the basis of a rotation of the winding stem 410. It is constituted such that, when the winding stem 410 exists in its 0th stage, the winding stem positioning part 662*f* of the battery plus terminal 662 is located between the base axle part 410*k* and the 2nd abacus bead part 410*j*. It is constituted such that, when the winding stem 410 exists in its 1st stage, the winding stem positioning part 662*f* of the battery plus terminal 662 is located between the 1st abacus bead part 410*h* and the 2nd abacus bead part 410*j*. It is constituted such that, when the winding stem 410 exists in its 2nd stage, the winding stem positioning part 662*f* of the battery plus terminal 662 is located between the 1st abacus bead part 410*h* and the 3rd axle part 410*g*. Accordingly, in the rocking device of the above constitution, by the winding stem positioning part 662*f* of the battery plus terminal 662, the winding stem 410 can be positioned in three positions (0th stage, 1st stage and 2nd stage) in an axial direction.

It is constituted such that, when the winding stem 410 exists in its 0th stage and when the winding stem 410 exists in its 1st stage, the train wheel setting lever 468 does not set a gear wheel part of the fifth wheel & pinion 441 without the second setting operation axle part 410*d* of the winding stem 410 contacting with the train wheel setting lever 468. It is constituted such that, when the winding stem 410 exists in its 2nd stage, the second setting operation axle part 410*d* of the winding stem 410 contacts with the train wheel setting lever 468, thereby setting the gear wheel part of the fifth wheel & pinion 441.

A 1st calendar corrector wheel 590 is disposed so as to have the same rotation axis as the rotation axis of the winding stem 410. It is constituted such that, when the winding stem 410 exists in its 0th stage, an interlock circular hole of the 1st calendar corrector wheel 590 is rotatable with respect to the 3rd axle part 410*g* of the winding stem 410, and the 1st calendar corrector wheel 590 is not rotated even if the winding stem 410 is rotated. It is constituted such that, when the winding stem 410 exists in its 1st stage, the interlock circular hole of the 1st calendar corrector wheel 590 fits with the 2nd angular part 410*f* of the winding stem 410, and the 1st calendar corrector wheel 590 is rotated on the basis of the rotation of the winding stem 410. It is constituted such that, when the winding stem 410 exists in its 2nd stage, the interlock circular hole of the 1st calendar corrector wheel 590 is rotatable with respect to the 2nd axle part 410*e* of the winding stem 410, and the1st calendar corrector wheel 590 is not rotated even if the winding stem 410 is rotated.

A minute gear wheel 448*a* of the minute wheel 448 is disposed so as to mesh with a setting wheel 449. The setting wheel 449 is disposed between the main plate 402 and the train wheel bridge 458. A minute pinion (not shown in the drawing) of the minute wheel 448 is constitutes so as to be located in the dial side of the main plate 402, and mesh with the hour gear wheel 480*a* of the hour wheel 480. A hole part of the hour wheel 480 is rotatably supported by an outer periphery part of an axle portion of the center pipe 402*c*.

(1.5) Constitution of 1st Date Indicator Unlocking Mechanism

Hereunder, it is explained about a constitution of a 1st date indicator unlocking mechanism. Referring to FIG. 1–FIG. 4 and FIG. 18, in the movement 400, a date unlocking mechanism contains a date indicator driving wheel 510 and a 1st date jumper 514. The date indicator driving wheel 510 contains a date indicator driving gear wheel 510*c* and a date indicator driving pawl 510*d*. The date unlocking gear wheel 480*b* of the hour wheel 480 meshes with the date indicator driving gear wheel 510*c*. It is constituted such that, by a rotation of the hour wheel 480, the date indicator driving wheel 510 performs one rotation in 24 hours. A 1st date indicator 552 is rotatably incorporated in to the main plate 402. The1st date jumper 514 is incorporated into the main plate 402. The 1st date jumper 514 contains a spring part 514*b*, and setting parts 514*c*, 514*d* provided in a tip of the spring part. The setting parts 514*c*, 514*d* of the 1st date jumper 514 set a teeth part of the 1st date indicator 552. It is constituted such that, by the fact that the date indicator driving wheel 510 is rotated, the 1st date indicator 552 is rotated once by for one pitch (one tooth) in one day.

Figure 4:
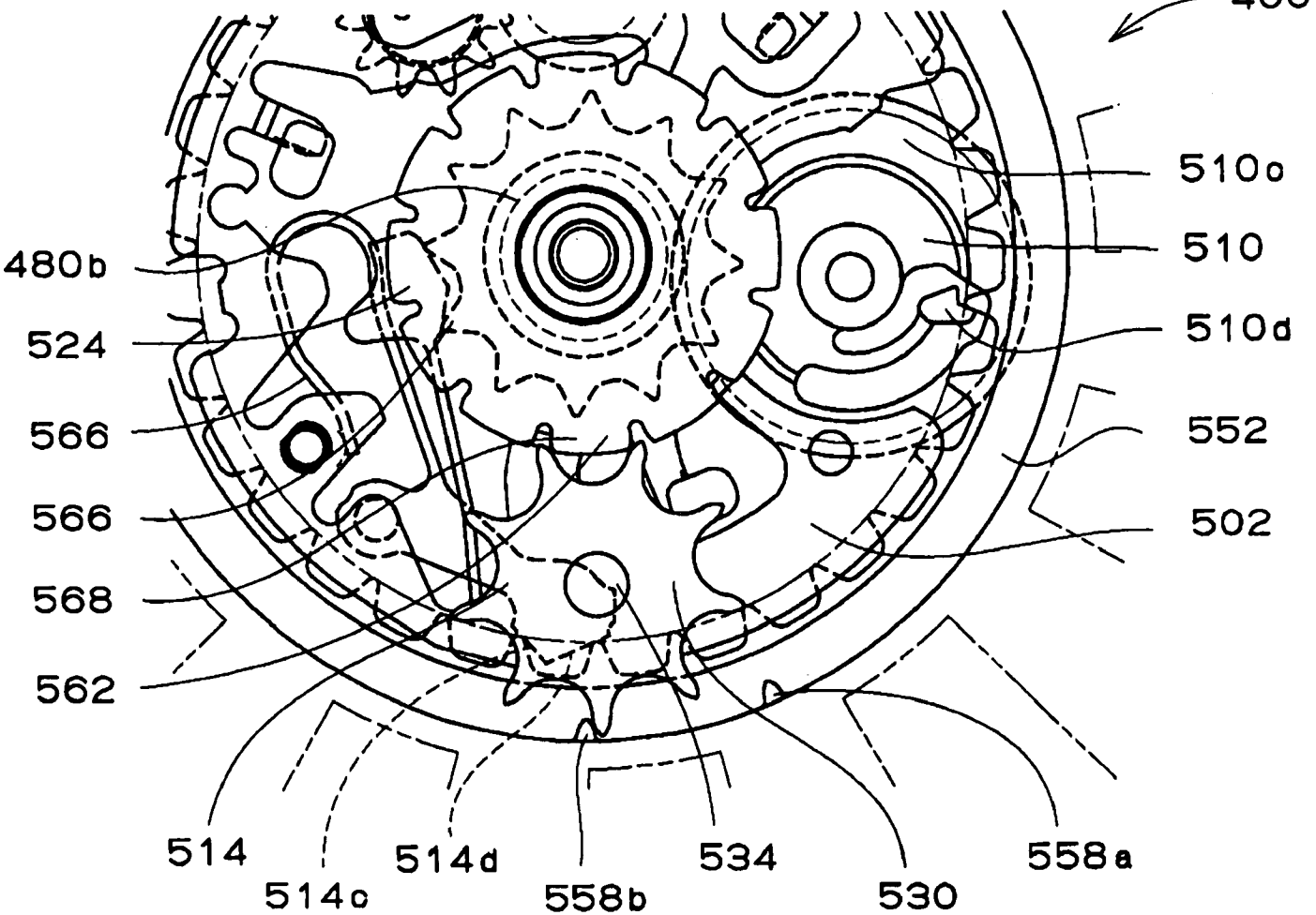
FIG. 4 is an enlarged partial plan view showing one portion of the calendar mechanism when the movement is seen from the dial side in the 1st embodiment of the time piece with the calendar mechanism of the present invention.

(1.6) Constitution of Calendar Mechanism (1.6.1) Constitutions of 1st Date Indicator and 2nd Date Indicator Hereunder, it is explained about a constitution of a calendar mechanism of the timepiece equipped with the calendar mechanism of the present invention. FIG. 4 is a partial plan view showing a structure of the back side of the movement 400 seen from the dial side under a state that the 1st date indicator 552 is being attempted to be rotated in a positive direction (counterclockwise direction) in the timepiece with the calendar mechanism of the present invention. Referring to FIG. 3, FIG. 4 and F*ig*. 18, the movement 400 has the date indicator driving wheel 510 rotated by the rotation of the hour wheel 480, the 1st date indicator 552 displaying the place of units among dates (i.e., for displaying the units numeral of the date), the 1st date jumper 514 for setting a position of the 1st date indicator 552 in its rotation direction, a 2nd date indicator 562 displaying the place of tens among dates (i.e., for displaying the tens numeral of the date), a 2nd date jumper 524 for setting a position of the 2nd date indicator 562 in its rotation direction, and a date intermediate wheel 530 which is rotated on the basis of the rotation of the 1st date indicator 552, thereby being capable of rotating the 2nd date indicator 562. The 1st date indicator 552 is provided so as to be rotatable with respect to the main plate 402. The 2nd date indicator 562 is provided so as to be rotatable with respect to the hour wheel 480. A rotation center of the 1st date indicator 552 and a rotation center of the 2nd date indicator 562 exist in the same position (i.e., the center axis of the 1st date indicator is coincident with the center axis of the 2nd date indicator). That is, the rotation center of the 1st date indicator 552 and the rotation center of the 2nd date indicator 562 are disposed in the same position as a rotation center of the hour hand 464 (i. e., rotation center of the hour wheel 480). The date intermediate wheel 530 is provided so as to be rotatable with respect to a date intermediate wheel pin 534 fixed to a date indicator maintaining plate 502. The setting parts 514*c*, 514*d* of the 1st date jumper 514 set a teeth part of the 1st date indicator 552.

Figure 5:
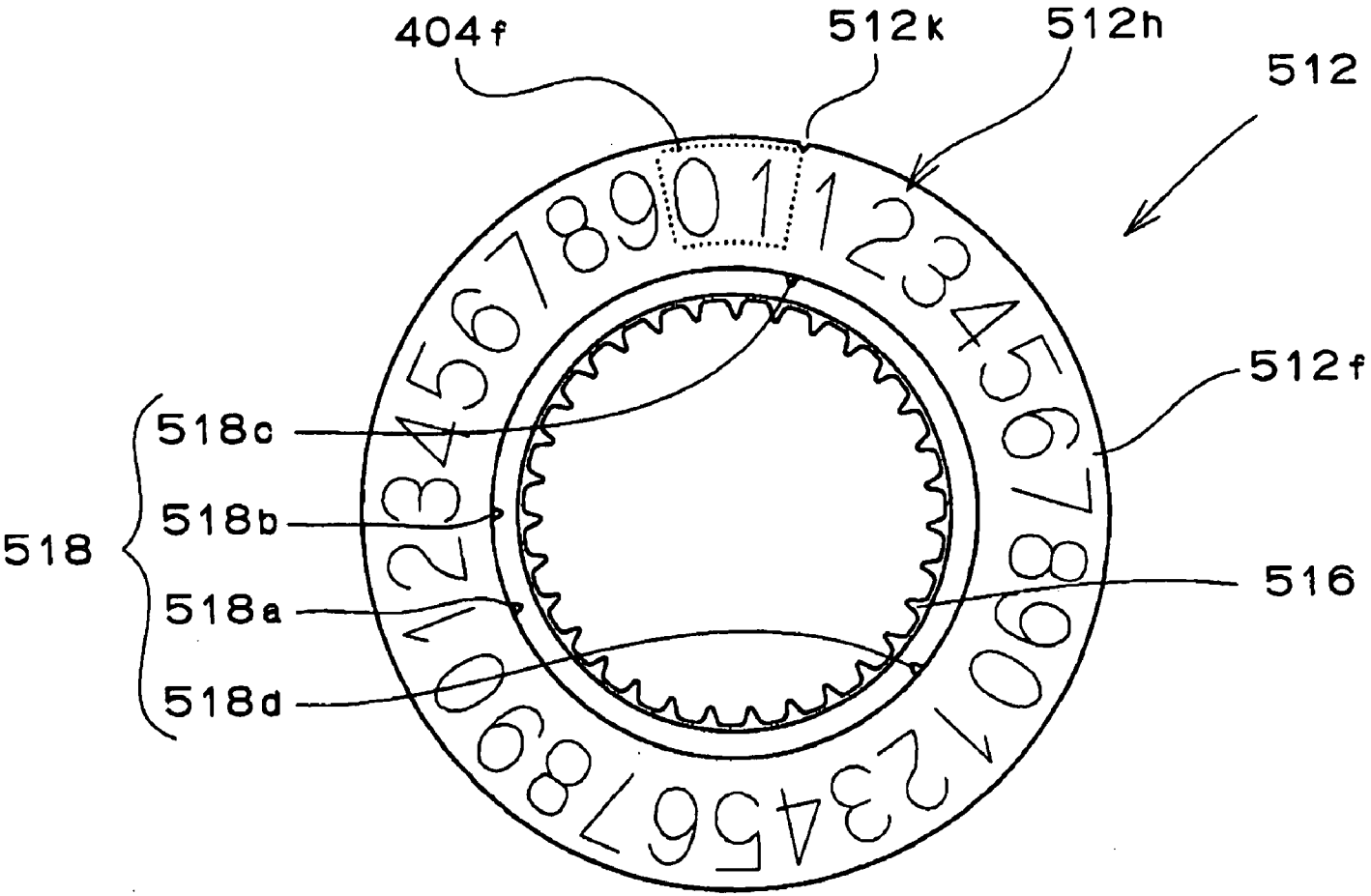
FIG. 5 is a plan view showing a 1st date indicator in a constitution in which a date window is disposed in a 12 o'clock direction of a dial in the 1st embodiment of the timepiece with the calendar mechanism of the present invention.

Referring to FIG. 5, in a case of a constitution in which a date window 404*f* is formed in a 12 o'clock position of the dial 404, a 1st date indicator 512 possesses a ring-shaped 1st date letter display face 512*f*. The 1st date indicator 512 contains 31 1st date indicator teeth parts 516 formed as internal teeth, and 4 calendar shift teeth 518 formed as internal teeth. The 1st date indicator teeth parts 516 are formed with a spacing of equal angle, i.e., spacing of (360/31) degrees. The calendar shift teeth 518 comprise a 1st calendar shift tooth 518*a* becoming a reference, a 2nd calendar shift tooth 518*b* formed with a spacing of (360×2/31) degrees in a clockwise direction with the 1st calendar shift tooth 518*a* being made the reference, a 3rd calendar shift tooth 518*c* formed with a spacing of (360×10/31) degrees in the clockwise direction with the 2nd calendar shift tooth 518*b* being made a reference, and a 4th calendar shift tooth 518*d* formed with a spacing of (360×9/31) degrees in the counterclockwise direction with the 1st calendar shift tooth 518*a* being made the reference.

1st date letters 512*h* consisting of 31 numerals are provided in the 1st date letter display face 512*f*. The 1st date letters 512*h* contain 4 sets of numerals. That is, the 1st date letters 512*h* contain numerals of "1" to "9" and "0" which constitute a 1st set of the 1st date letters, numerals of "1" to "9" and "0" which constitute a 2nd set of the 1st date letters, numerals of "1" to "9" and "0" which constitute a 3rd set of the 1st date letters, and numeral of "1" which constitutes a 4th set of the 1st date letters. That is, the 1st date letters 512*h* contain 31 numerals of "1", "1", "2", "3", "4", "5", "6", "7", "9", "0", "1", "2", "3", "4", "5", "6", "7", "8", "9", "0", "1", "2", "3", "4", "5", "6", "7", "8", "9", "0" The 31 numerals constituting the 1st date letters 512*h* are disposed in the 1st date letter display face 512*f* with a spacing of equal angle, i.e., spacing of (360/31) degrees. In a state shown in FIG. 5, among the 1st date letters 512*h*, "0" and "1" adjacently disposed are disposed in the date window 404*f* provided in the dial 404. A notch part 512*k* is formed in an outer periphery part of the 1st date letter display face 512*f* so as to correspond to a position between "1" and "1" adjacently disposed among the 1st date letters 512*h*.

Figure 6:
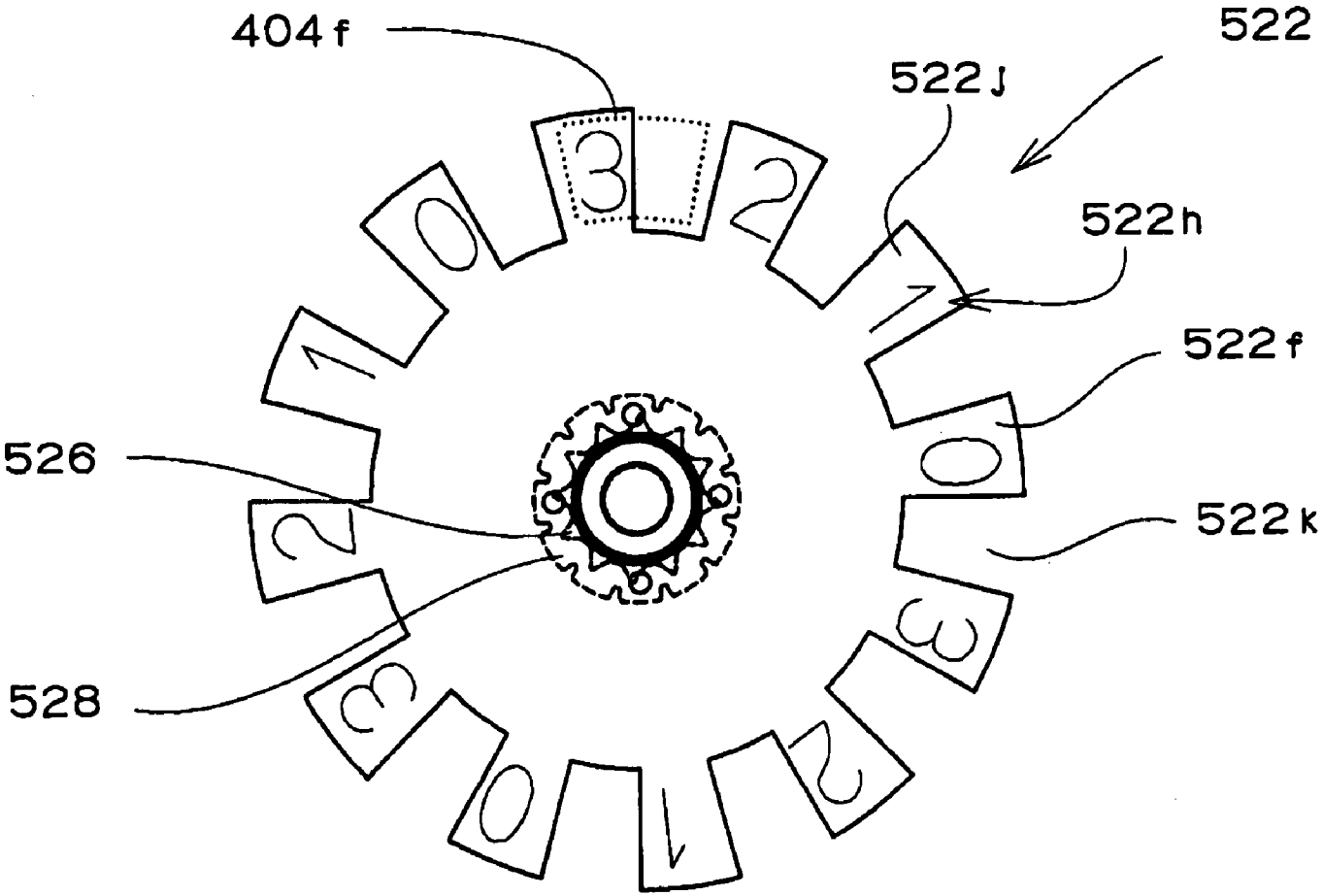
FIG. 6 is a plan view showing a 2nd date indicator in the constitution in which the date window is disposed in the 12 o'clock direction of the dial in the 1st embodiment of the timepiece with the calendar mechanism of the present invention.

Referring to FIG. 6, a 2nd date indicator 522 possesses a disc-shaped 2nd date letter display face 522*f* provided with notches. The 2nd date letter display face 522*f* contains 12 trapezoid portion 522*j* formed with a spacing of (360/12) degrees, and 12 notch parts 522*k* formed with the spacing of (360/12) degrees. Additionally, the 2nd date indicator 522 contains 12 positioning teeth parts 526 formed as external teeth, and 12 unlocking teeth 528 formed as external teeth. The positioning teeth parts 526 are formed with the spacing of equal angle, e.g., spacing of (360/12) degrees. The unlocking teeth 528 are formed with the spacing of equal angle, e.g., spacing of (360/12) degrees. 2nd date letters 522*h* consisting of "1", "2", "3", "0" are provided in the 2nd date letter display face 522*f*. Numeral of "1" and numeral of "2" are disposed in the 2nd date letter display face 522*f* with a spacing of 30 degrees. Numeral of "2" and numeral of "3" are disposed in the 2nd date letter display face 522*f* with the spacing of 30 degrees. Numeral of "3" and numeral of "0" are disposed in the 2nd date letter display face 522*f* with the spacing of 30 degrees. Accordingly, in the 2nd date letter display face 522*f*, there are disposed numeral of "1", numeral of "2", numeral of "3" and numeral of "0" so as to mutually form the spacing of 30 degrees. In the 2nd date letter display face 522*f*, there are provided sets of numerals consisting of numeral of "1", numeral of "2", numeral of "3" and numeral of "0" by 3 sets. Or, it is also possible to adopt a constitution in which, instead of providing numeral of "0", that position is made a "white paper" portion (i.e., blank portion in which no numeral is provided). Under the state shown in FIG. 6, among the 2nd date letters 522*h*, "3" is disposed in a left side portion of the date window 404*f* provided in the dial 404.

Figure 7:
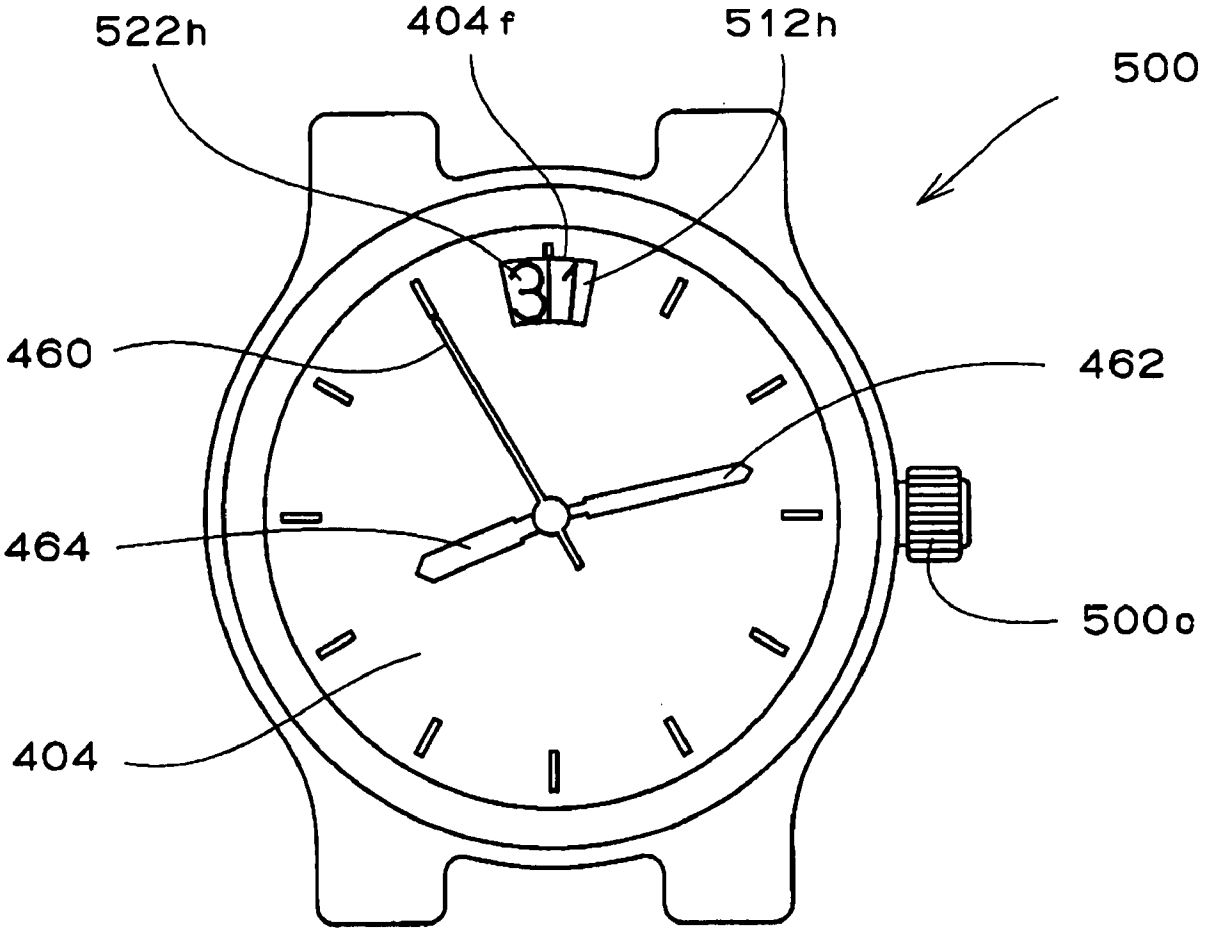
FIG. 7 is a plan view showing a complete in the constitution in which the date window is disposed in the 12 o'clock direction of the dial in the 1st embodiment of the timepiece with the calendar mechanism of the present invention.

The 2nd date letter display face 522*f* is disposed in a position nearer to the dial 404 than the 1st date letter display face 512*f*. Referring to FIG. 7, in a complete 500 of the timepiece with the calendar mechanism of the present invention, the date window 404*f* is formed in the 12 o'clock position of the dial 404. In the complete 500, in the left side portion within the date window 404*f* of the dial 404, there is disposed "3" among the 2nd date letters 522*h* of the 2nd date indicator 522 and, in a right side portion within the date window 404*f*, there are disposed the notch part 522*k* of the 2nd date indicator 522 and "1" among the 1st date letters 512*h*. Accordingly, the complete 500 is displaying "31st" day.

Figure 8:
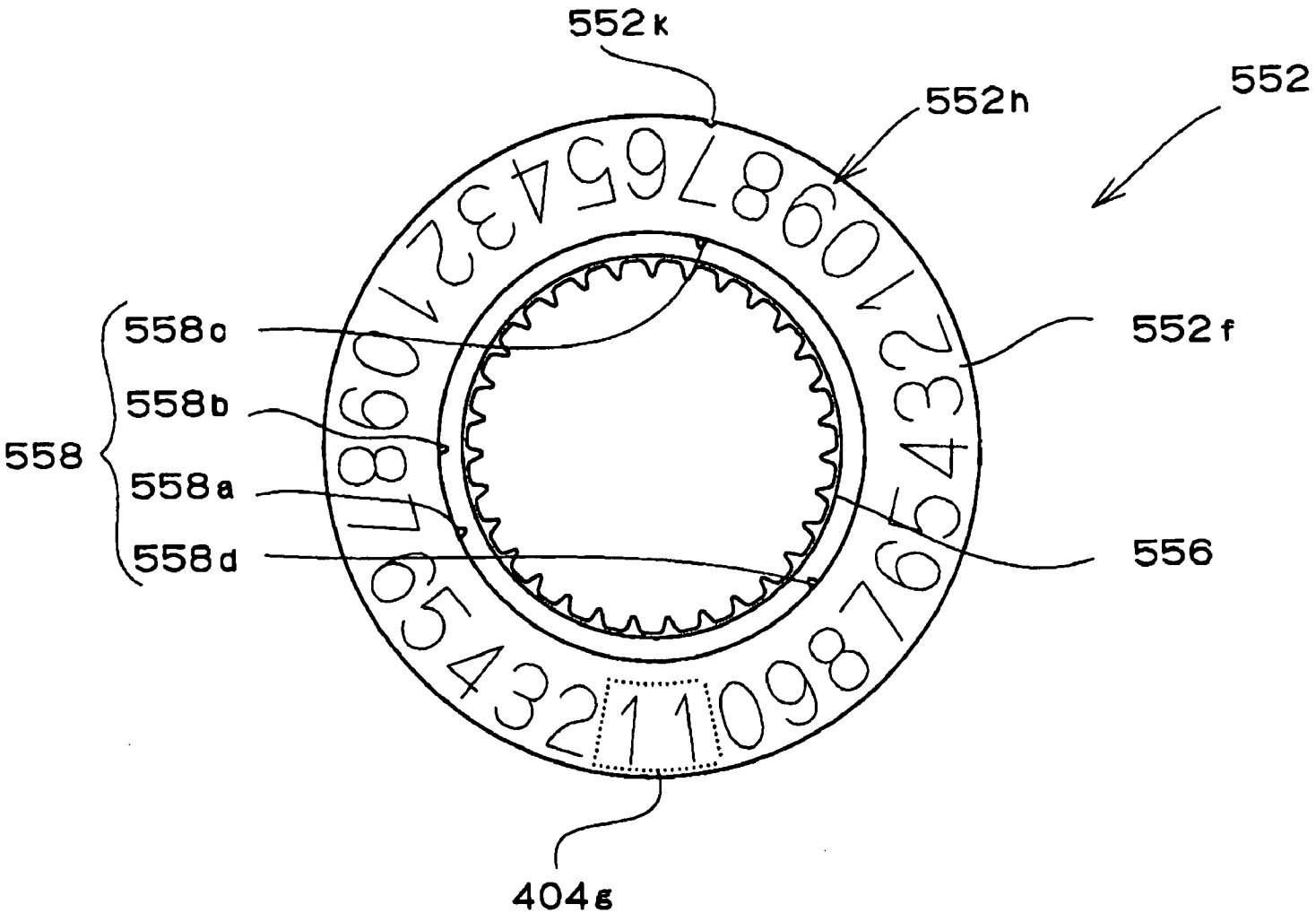
FIG. 8 is a plan view showing the 1st date indicator in a constitution in which the date window is disposed in a 6 o'clock direction of the dial in the 1st embodiment of the timepiece with the calendar mechanism of the present invention.

Referring to FIG. 8, in a case of a constitution in which a date window 404*g* is formed in a 6 o'clock position of the dial 404, a 1st date indicator 552 possesses a ring-shaped 1st date letter display face 552*f*. The 1st date indicator 552 contains 31 1st date indicator teeth parts 556 formed as internal teeth, and 4 calendar shift teeth 558 formed as internal teeth. The 1st date indicator teeth parts 556 are formed with a spacing of equal angle, i.e., spacing of (360/31) degrees. The calendar shift teeth 558 comprise a 1st calendar shift tooth 558*a* becoming a reference, a 2nd calendar shift tooth 558*b* formed with a spacing of (360×2/31) degrees in the clockwise direction with the 1st calendar shift tooth 558*a* being made the reference, a 3rd calendar shift tooth 558*c* formed with a spacing of (360×10/31) degrees in the clockwise direction with the 2nd calendar shift tooth 558*b* being made a reference, and a 4th calendar shift tooth 558*d* formed with a spacing of (360×9/31) degrees in the counterclockwise direction with the 1st calendar shift tooth 558*a* being made the reference. 1st date letters 552*h* consisting of 31 numerals are provided in the 1st date letter display face 552*f*. The 1st date letters 552*h* contain 4 sets of numerals. That is, the 1st date letters contain numerals of "1" to "9" and "0" which constitute a 1st set of the 1st date letters, numerals of "1" to "9" and "0" which constitute a 2nd set of the 1st date letters, numerals of "1" to "9" and "0" which constitute a 3rd set of the 1st date letters, and numeral of "1" which constitutes a 4th set of the 1st date letters. The 31 numerals constituting the 1st date letters 552*h* are disposed in the 1st date letter display face 552*f* with the equal spacing, i.e., spacing of (360/31) degrees. In a state shown in FIG. 8, among the 1st date letters 552*h*, "1" and "1" adjacently disposed are disposed in the date window 404*g* provided in the dial 404. A notch part 552*k* is formed in an outer periphery part of the 1st date letter display face 552*f* so as to correspond to a position of "7" existing in a position opposite to a center of the 1st date indicator 552 with respect to "1" and "1" adjacently disposed among the 1st date letters 552*h*.

Figure 9:
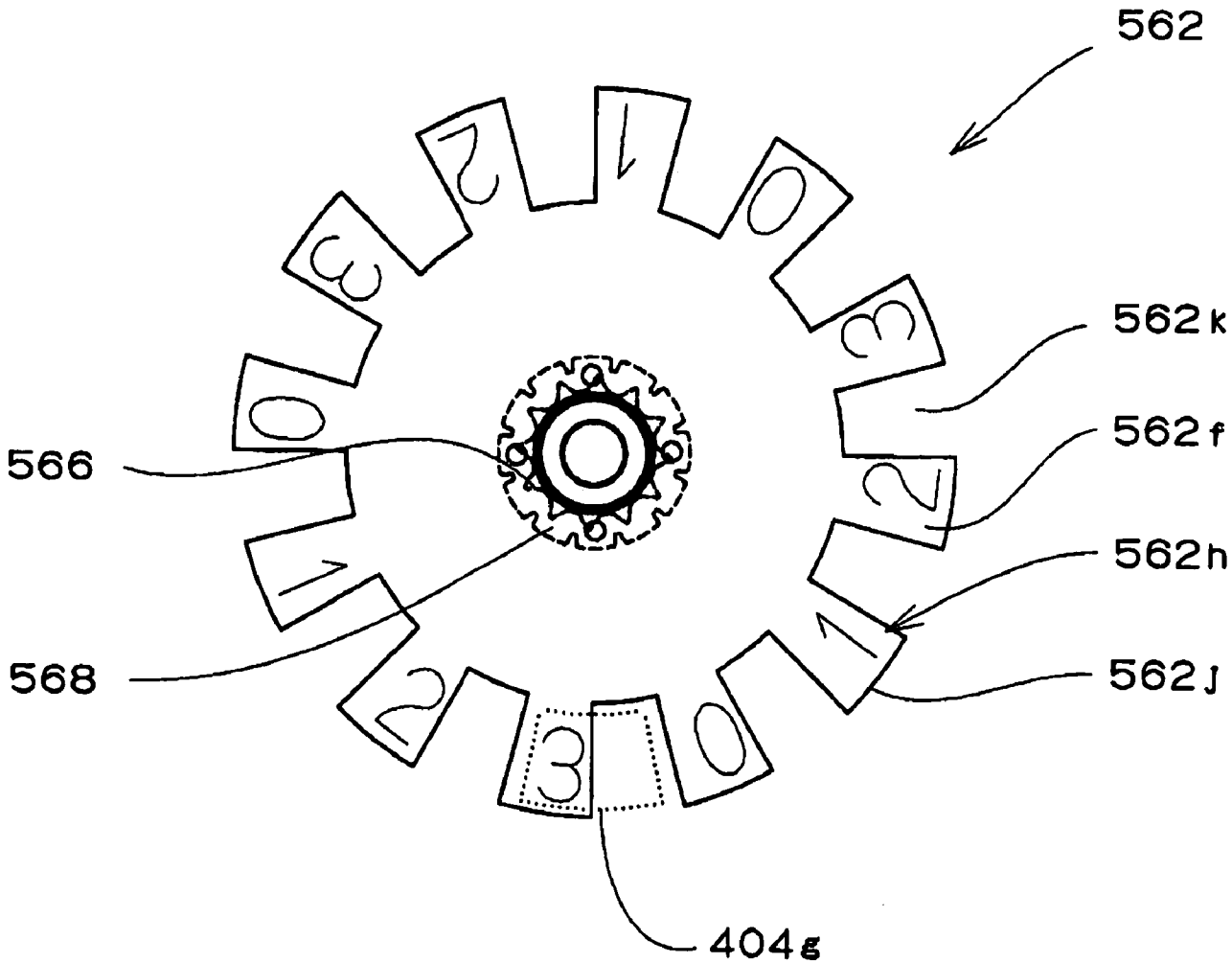
FIG. 9 is a plan view showing the 2nd date indicator in the constitution in which the date window is disposed in the 6 o'clock direction of the dial in the 1st embodiment of the timepiece with the calendar mechanism of the present invention.

Referring to FIG. 9, a 2nd date indicator 562 possesses a disc-shaped 2nd date letter display face 562*f* provided with notches. The 2nd date letter display face 562*f* contains 12 trapezoid portion 562*j* formed with the spacing of (360/12) degrees, and 12 notch parts 562*k* formed with the spacing of (360/12) degrees. Additionally, the 2nd date indicator 562 contains 12 positioning teeth parts 566 formed as external teeth, and 12 unlocking teeth 568 formed as external teeth. The positioning teeth parts 566 are formed with the spacing of equal angle, e.g., spacing of (360/12) degrees. The unlocking teeth 568 are formed with the spacing of equal angle, e.g., spacing of (360/12) degrees. 2nd date letters 562*h* consisting of "1", "2", "3", "0" are provided in a 2nd date letter display face 562*f*. Numeral of "1" and numeral of "2" are disposed in the 2nd date letter display face 562*f* with the spacing of 30 degrees. Numeral of "2" and numeral of "3" are disposed in the 2nd date letter display face 562*f* with the spacing of 30 degrees. Numeral of "3" and numeral of "0" are disposed in the 2nd date letter display face 562*f* with the spacing of 30 degrees. Accordingly, in the 2nd date letter display face 562*f*, there are disposed numeral of "1", numeral of "2", numeral of "3" and numeral of "0" so as to mutually form the spacing of 30 degrees. In the 2nd date letter display face 562*f*, there are provided sets of numerals consisting of numeral of "1", numeral of "2", numeral of "3" and numeral of "0" by 3 sets. Or, it is also possible to adopt the constitution in which, instead of providing numeral of "0", that position is made the "white paper" portion (i.e., blank portion in which no numeral is provided). Under the state shown in, FIG. 9, among the 2nd date letters 562*h*, "3" is disposed in a left side portion of the date window 404*g* provided in the dial 404.

Figure 10:
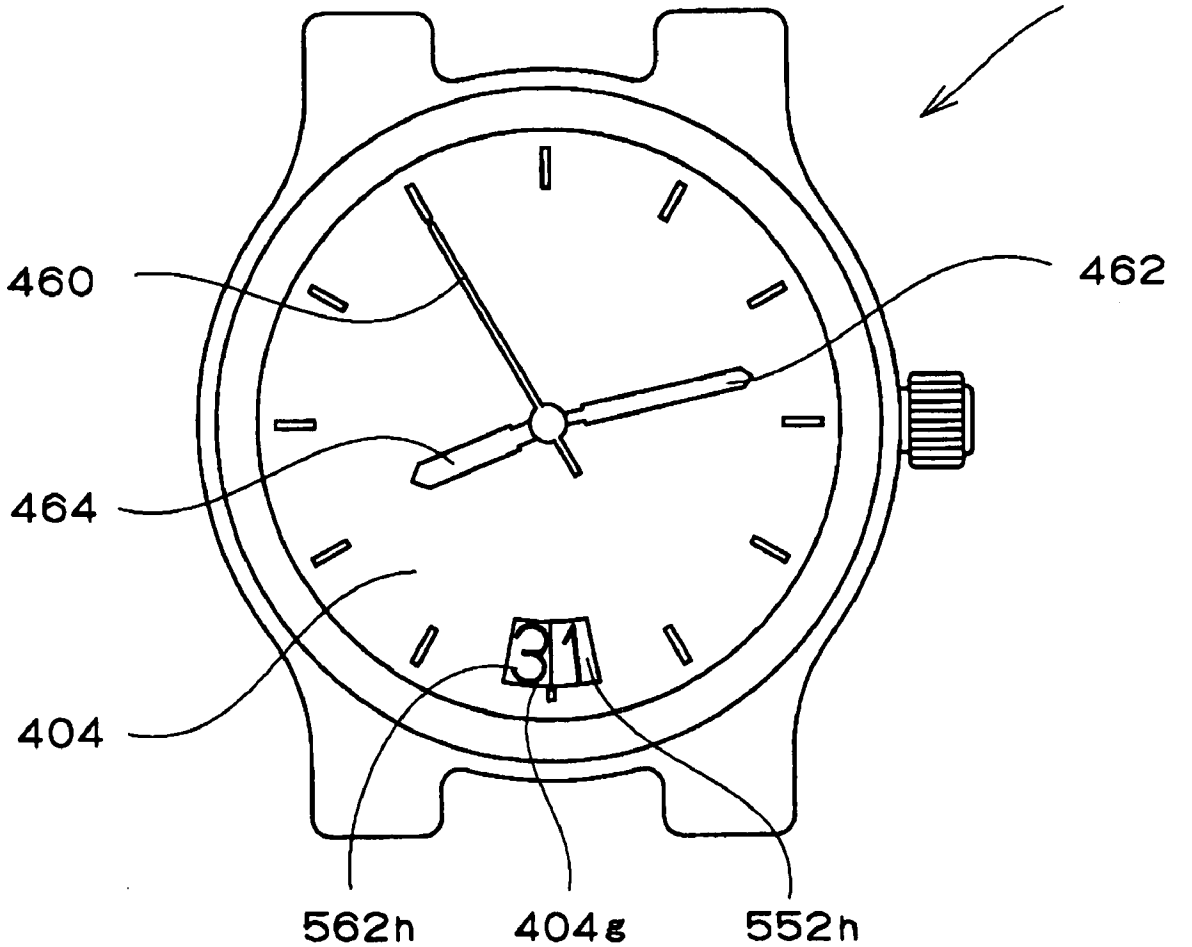
FIG. 10 is a plan view showing the complete in the constitution in which the date window is disposed in the 6 o'clock direction of the dial in the 1st embodiment of the timepiece with the calendar mechanism of the present invention.

Referring to FIG. 10, in a complete 550 of the timepiece with the calendar mechanism of the present invention, the date window 404*g* is formed in the 6 o'clock position of the dial 404. In the complete 550, in the left side portion within the date window 404*g* of the dial 404, there is disposed "3" among the 2nd date letters 562*h* of the 2nd date indicator 562 and, in a right side portion within the date window 404*g*, there are disposed the notch part 562*k* of the 2nd date indicator 562 and "1" among the 1st date letters 552*h*. Accordingly, the complete 550 is displaying "31st" day.

Figure 11:
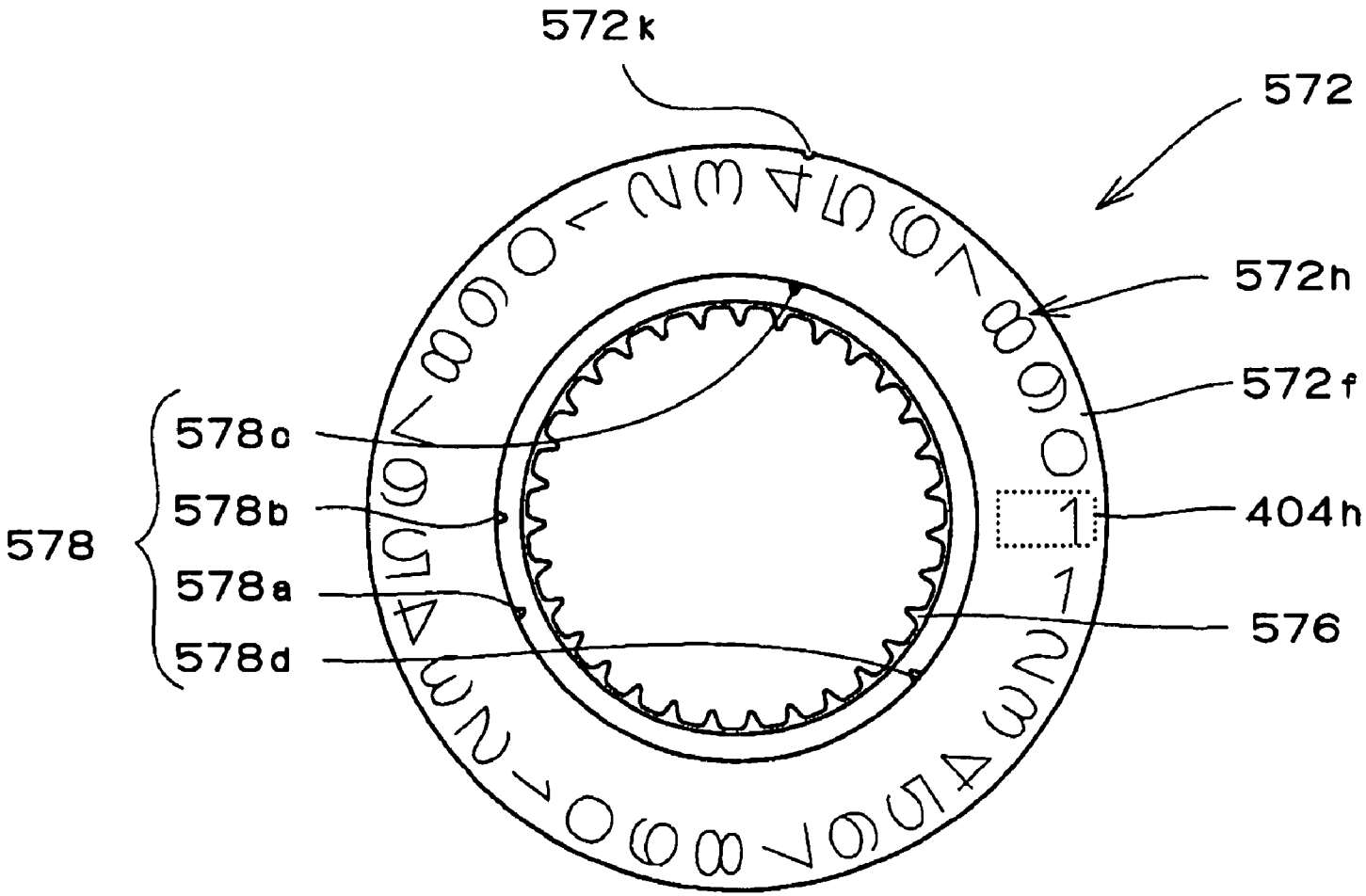
FIG. 11 is a plan view showing the 1st date indicator in the constitution in which the date window is disposed in a 3 o'clock direction of the dial in the 1st embodiment of the timepiece with the calendar mechanism of the present invention.

Referring to FIG. 11, in a case of a constitution in which a date window 404*h* is formed in a 3 o'clock position of the dial 404, a 1st date indicator 572 possesses a ring-shaped 1st date letter display face 572*f*. The 1st date indicator 572. contains 31 1st date indicator teeth parts 576 formed as internal teeth, and 4 calendar shift teeth 578 formed as internal teeth. The 1st date indicator teeth parts 576 are formed with the spacing of equal angle, i.e., spacing of (360/31) degrees. The calendar shift teeth 578 comprise a 1st calendar shift tooth 578*a* becoming a reference, a 2nd calendar shift tooth 578*b* formed with the spacing of (360×2/31) degrees in the clockwise direction with the 1st calendar shift tooth 578*a* being made the reference, a 3rd calendar shift tooth 578*c* formed with the spacing of (360×10/31) degrees in the clockwise direction with the 2nd calendar shift tooth 578*b* being made a reference, and a 4th calendar shift tooth 578*d* formed with the spacing of (360×9/31) degrees in the counterclockwise direction with the 1st calendar shift tooth 578*a* being made the reference. 1st date letters 572*h* consisting of 31 numerals are provided in the 1st date letter display face 572*f*. The 1st date letters 572*h* contain 4 sets of numerals. That is, the 1st date letters contain numerals of "1" to "9" and "0" which constitute a 1st set of the 1st date letters, numerals of "1" to "9" and "0" which constitute a 2nd set of the 1st date letters, numerals of "1" to "9" and "0" which constitute a 3rd set of the 1st date letters, and numeral of "1" which constitutes a 4th set of the 1st date letters. The 31 numerals constituting the 1st date letters 572*h* are disposed in the 1st date letter display face 572*f* with the equal spacing, i.e., spacing of (360/31) degrees. In a state shown in FIG. 11, among the 1st date letters 572*h*, "1" existing near to "0" between two "1" adjacently disposed is disposed in a right side portion of the date window 404*h* provided in the dial 404. A notch part 572*k* is formed in an outer periphery part of the 1st date letter display face 572*f* so as to correspond to a position of "4" existing in a position in the counterclockwise direction with respect to "1" and "1" adjacently disposed among the 1st date letters 572*h*.

Figure 12:
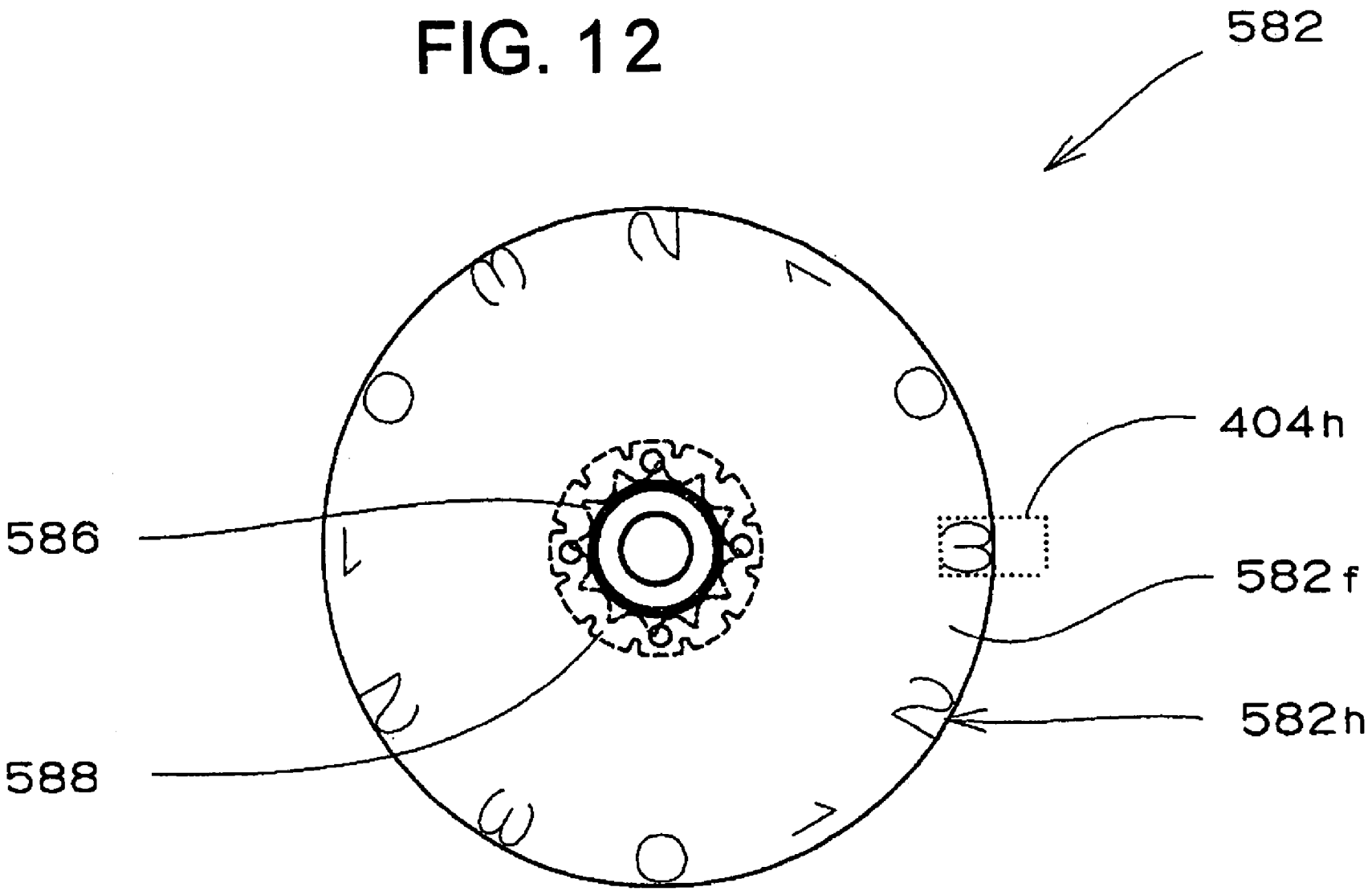
FIG. 12 is a plan view showing the 2nd date indicator in the constitution in which the date window is disposed in the 3 o'clock direction of the dial in the 1st embodiment of the timepiece with the calendar mechanism of the present invention.

Referring to FIG. 12, a 2nd date indicator 582 possesses a disc-shaped 2nd date letter display face 582*f*. It is constituted such that an outer diameter of the 2nd date letter display face 582*f* is smaller than a size of a region where the date letters of the 1st date letter display face 572*f* are disposed. The 2nd date indicator 582 contains 12 positioning teeth parts 586 formed as external teeth, and 12 unlocking teeth 588 formed as external teeth. The positioning teeth parts 586 are formed with the spacing of equal angle, e.g., spacing of (360/12) degrees. The unlocking teeth 588 are formed with the spacing of equal angle, e.g., spacing of (360/12) degrees. 2nd date letters 582*h* consisting of "1", "2", "3", "0" are provided in the 2nd date letter display face 582*f*. Numeral of "1" and numeral of "2" are disposed in the 2nd date letter display face 582*f* with the spacing of 30 degrees. Numeral of "2" and numeral of "3" are disposed in the 2nd date letter display face 582*f* with the spacing of 30 degrees. Numeral of "3" and numeral of "0" are disposed in the 2nd date letter display face with the spacing of 30 degrees. Accordingly, in the 2nd date letter display face 582*f*, there are disposed numeral of "1", numeral of "2", numeral of "3" and numeral of "0" so as to mutually form the spacing of 30 degrees. In the 2nd date letter display face 582*f*, there are provided sets of numerals consisting of numeral of "1", numeral of "2", numeral of "3" and numeral of "0" by 3 sets. Or, it is also possible to adopt the constitution in which, instead of providing numeral of "0", that position is made the "white paper" portion (i.e., blank portion in which: no numeral is provided). Under the state shown in FIG. 12, among the 2nd date letters 582*h*, "3" is disposed in a left side portion of the date window 404*h* provided in the dial 404.

Figure 13:
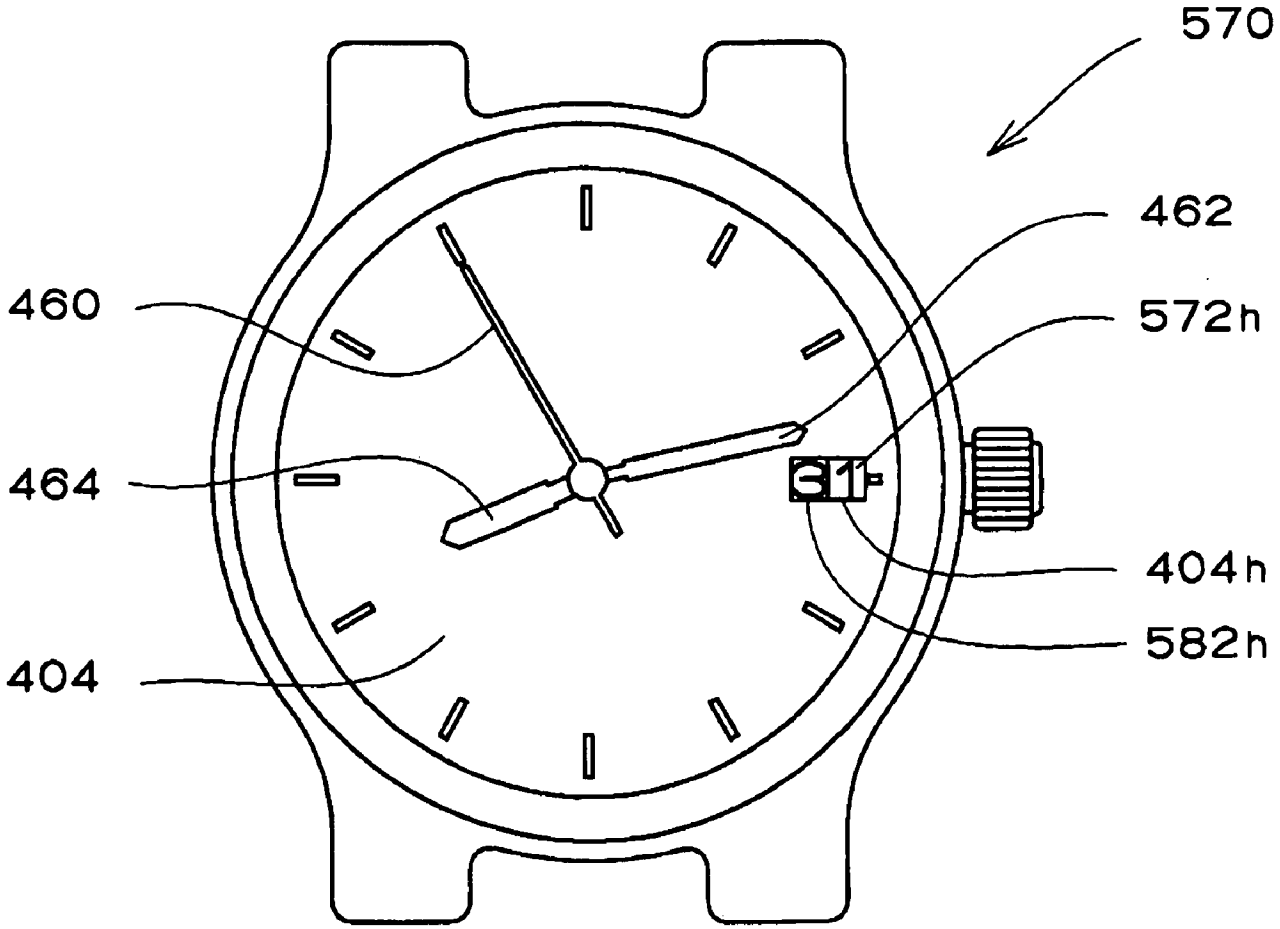
FIG. 13 is a plan view showing the complete in the constitution in which the date window is disposed in the 3 o'clock direction of the dial in the 1st embodiment of the timepiece with the calendar mechanism of the present invention.

Referring to FIG. 13, in a complete 570 of the timepiece with the calendar mechanism of the present invention, the date window 404*h* is formed in the 3 o'clock position of the dial 404. In the complete 570, in a left side portion within the date window 404*h* of the dial 404, there is disposed "3" among the 2nd date letters 582*h* of the 2nd date indicator 582 and, in a right side portion within the date window 404*h*, the 2nd date indicator 582 does not exist and "1" among the 1st date letters 572*h* is disposed. Accordingly, the complete 570 is displaying "31st" day.

Figure 14:
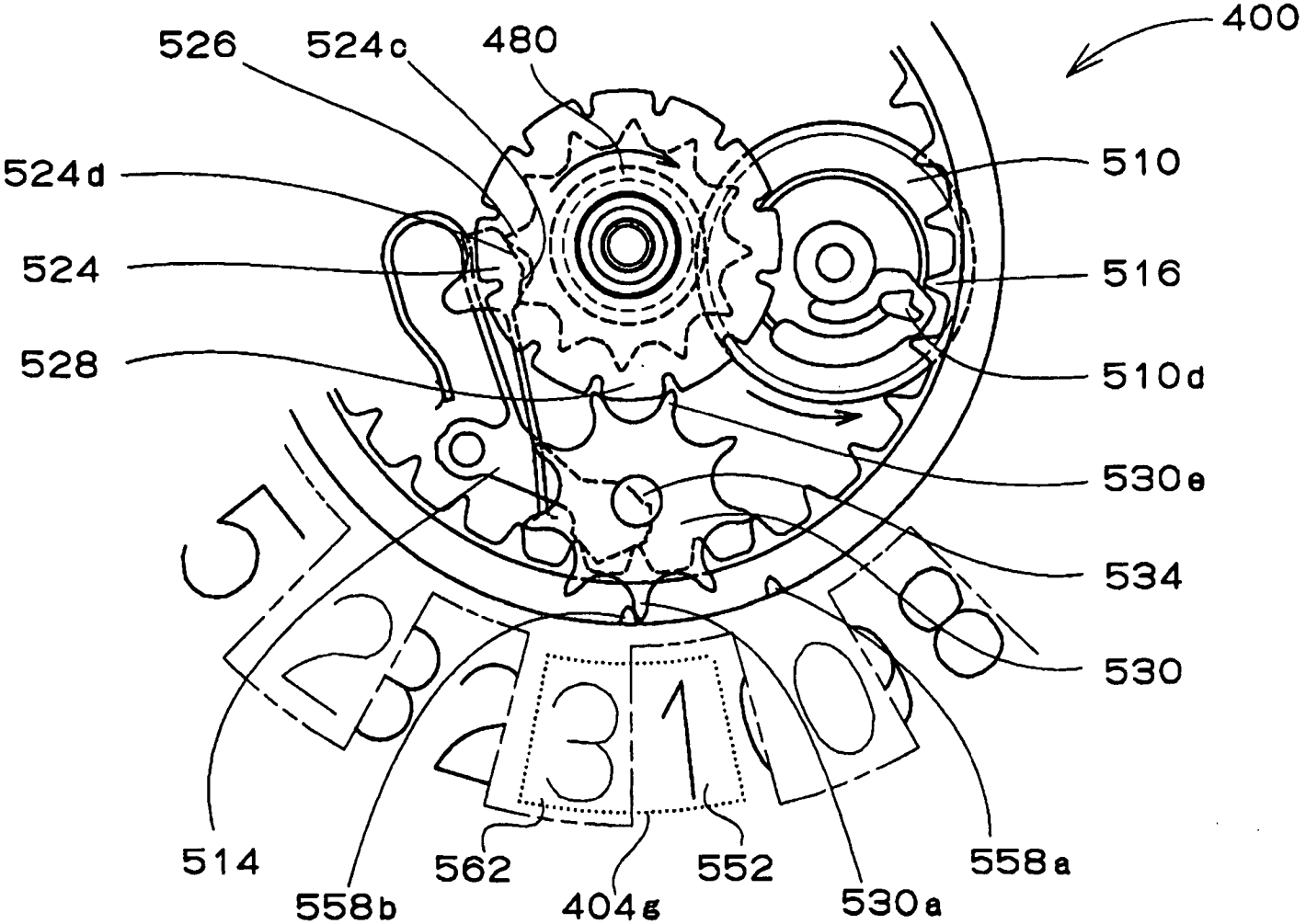
FIG. 14 is a partial plan view showing the structure of a back side of the movement seen from the dial side under a state before the 1st date indicator is rotated in the 1st embodiment of the timepiece with the calendar mechanism of the present invention.

(1.6.2) State That 1st Date Indicator is Attempted to be Rotated in Positive Direction FIG. 14 is a partial plan view showing a structure of the back side of the movement 400 seen from the dial side under a state before the 1st date indicator 552 is rotated (i.e., state before the date unlocking) in the timepiece with the calendar mechanism of the present invention. Referring to FIG. 14, setting parts 524*c*, 524*d* of the 2nd date jumper 524 set a positioning teeth part 526 of the 2nd date indicator 562. The date indicator driving wheel 510 contains one date indicator driving pawl 510*d*. The date indicator driving wheel 510 can rotate in a direction shown by an arrow (counterclockwise direction). The, date intermediate wheel 530 contains 9 date intermediate teeth 530*a* formed as external teeth. The date letter being displayed from the date window 404*g* by the 1st date indicator 552 is "1". The date letter being displayed from the date window 404*g* by the 2nd date indicator 562 is "3". That is, by the 1st date indicator 552 and the 2nd date indicator 562, the present date, "31st" day, is being displayed from the date window 404*g*.

Figure 15:
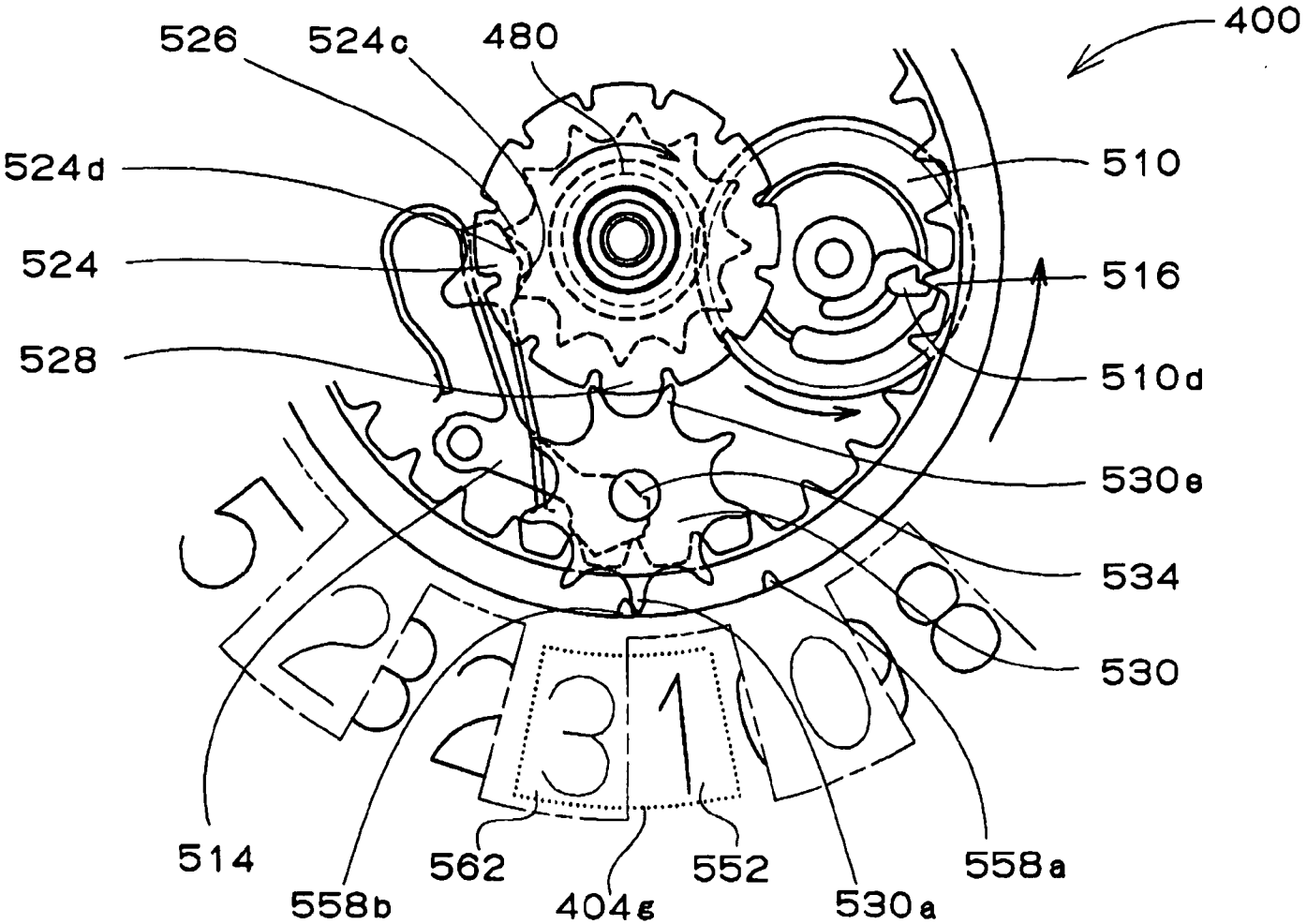
FIG. 15 is a partial plan view showing the structure of the back side of the movement seen from the dial side under a state that the 1st date indicator is starting a rotation in a positive direction in the 1st embodiment of the timepiece with the calendar mechanism of the present invention.

(1.6.3) State that 1st Date Indicator is Attempted to be Rotated in Positive Direction FIG. 15 is a partial plan view showing the structure of the back side of the movement 400 seen from the dial side under a state that the 1st date indicator 552 is attempted to be rotated in the positive direction (counterclockwise direction) (i.e., state that the date unlocking has been started) in the timepiece with the calendar mechanism of the present invention. Referring to FIG. 15, the setting parts 524*c*, 524*d* of the 2nd date jumper 524 are setting the positioning teeth part 526 of the 2nd date indicator 562. By the fact that the date indicator driving wheel 510 rotates in a direction shown by an arrow (counterclockwise direction), the date indicator driving pawl 510*d* starts to unlock the 1st date indicator teeth part 516, and theist date indicator 552 is rotated in the counterclockwise direction. When the date letter displayed from the date window 404*g* by the 1st date indicator 552 is being changed from "1" to next "1" adjoining the former "1", the 1st date indicator 552 rotates in the counterclockwise direction, and the 2nd calendar shift tooth 558*b* rotates the date intermediate tooth 530*a*. Thereupon, a date intermediate tooth 530*e* rotates an unlocking tooth 528 of the 2nd date indicator 562, thereby rotating the 2nd date indicator. 562 in the clockwise direction at the end of the month. Thereupon, the date letter displayed from the date window 404*g* by the 2nd date indicator 562 is attempted to be changed from "3" to "0" (or, state of "white paper").

(1.6.4) State that 1st Date Indicator is Being Rotated in Positive Direction

Figure 16:
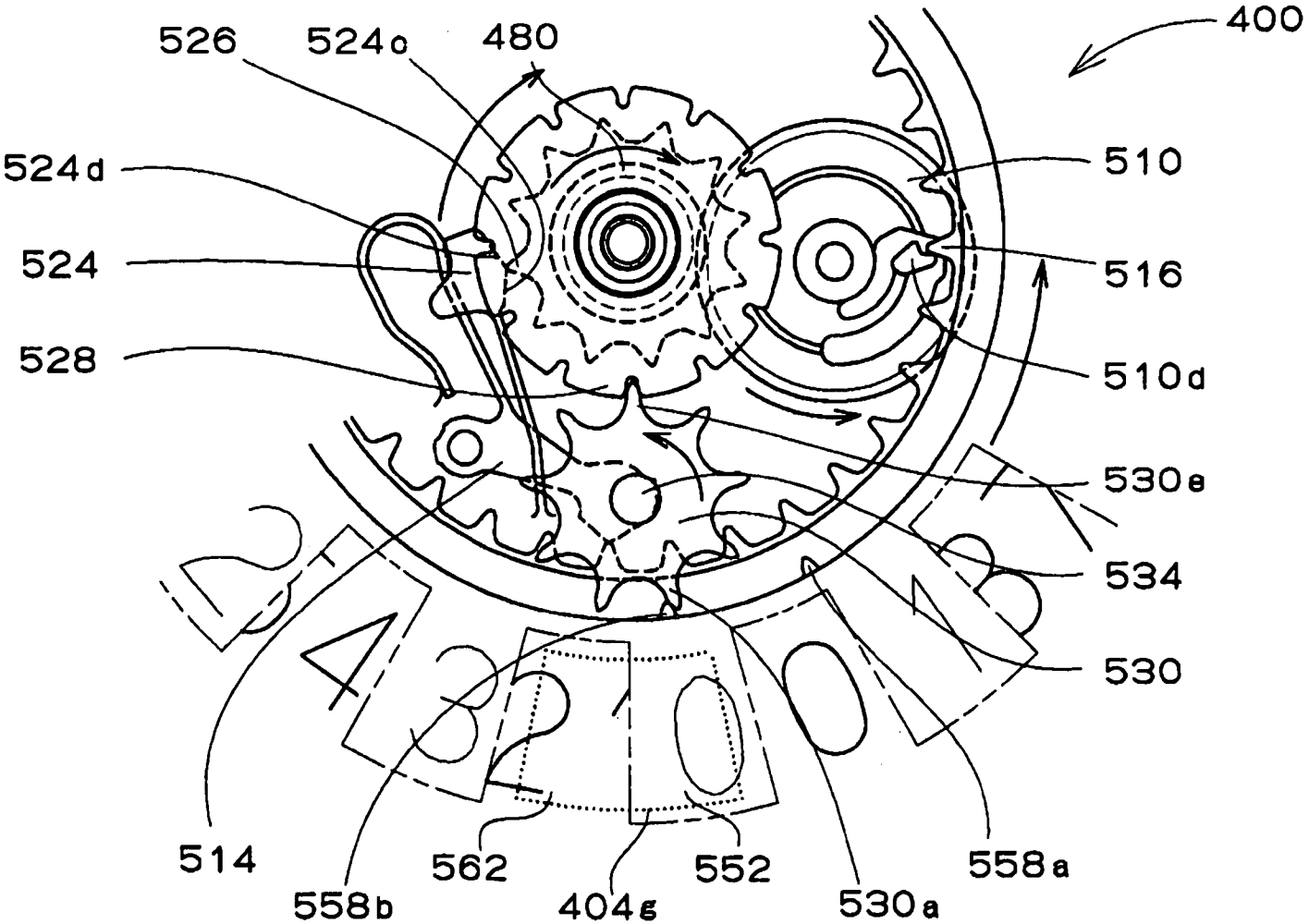
FIG. 16 is a partial plan view showing the structure of the back side of the movement seen from the dial side under a state that the 1st date indicator is attempting to rotate in the positive direction in the 1st embodiment of the timepiece with the calendar mechanism of the present invention.

FIG. 16 is a partial plan view showing the structure of the back side of the movement 400 seen from the dial side under a state that the 1st date indicator 552 rotates in the positive direction and a tip part of the tooth part 516 of the 1st date indicator 552 contacts with a tip part where the setting parts 514*c* and 514*d* of the 1st date jumper 514 intersect under a state that the 1st date indicator 552 is in a midway of being rotated in the positive direction (counterclockwise direction) in the timepiece with the calendar mechanism of the present invention. Referring to FIG. 16, by the fact that the date calendar driving wheel 510 rotates in the direction shown by the arrow, the date calendar driving pawl 510*d* continues to unlock the 1st date indicator teeth part 516, the date letter displayed from the date window 404*g* by the 1st date indicator 552 is attempted to be changed from "1" to next "1" adjoining the former "1", and the date letter displayed from the date window 404*g* by the 2nd date indicator 562 is attempted to be changed from "3" to "0" (or, state of "white paper"). In a midway of this unlocking state of the 1st date indicator 552, it becomes the state that the tip part of the tooth part 516 of the 1st date indicator 552 contacts with the tip part where the setting parts 514*c* and 514*d* of the 1st date jumper 514 intersect. Further, by the fact that the1st date indicator 552 rotates in the direction shown by the arrow, the 2nd calendar shift tooth 518*b* rotates the date intermediate tooth 530*a*, and the date intermediate tooth 530*e* rotates the unlocking tooth 528, thereby rotating the 2nd date indicator 562 in the counterclockwise direction in the direction shown by the arrow. In a midway of this unlocking state of the 2nd date indicator 562, it becomes a state that a tip part of the positioning tooth part 526 of the 2nd date indicator 562 contacts, with a tip part where the setting parts 524*c* and 524*d* of the 2nd date jumper 524 intersect.

Figure 17:
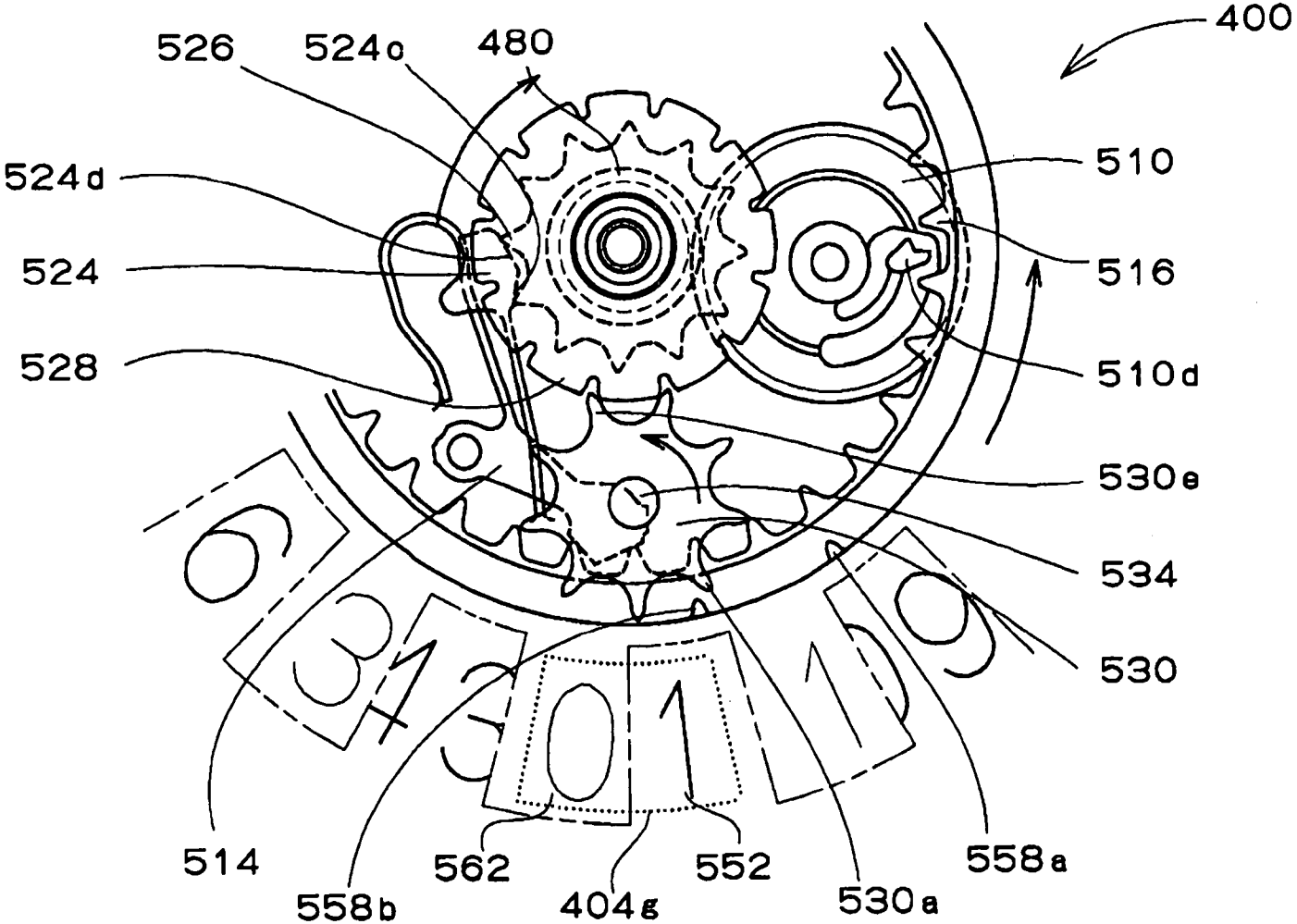
FIG. 17 is a partial plan view showing the structure of the back side of the movement seen from the dial side under a state that the 1st date indicator has rotated by one pitch in the positive direction in the 1st embodiment of the timepiece with the calendar mechanism of the present invention.

(1.6.5) State That 1st Date Indicator has Rotated by One Pitch in Positive Direction FIG. 17 is a partial plan view showing the structure of the back side of the movement 400 seen from the dial side under a state that the 1st date indicator 552 has rotated by one pitch (for one tooth of the 1st date indicator, i.e., by (360/31) degrees) in the positive direction (counterclockwise direction) in the timepiece with the calendar mechanism of the present invention. Referring to FIG. 17, if the date indicator driving wheel 510 additionally rotates in the direction shown by the arrow from the state shown in FIG. 16 and the date indicator driving pawl 510*d* rotates the 1st date indicator 552 in the direction shown by the arrow, by an elastic force of the 1st date jumper 514, the 1st date indicator 552 is positioned in a position rotated by (360/31) degrees in the counterclockwise direction from the state shown in FIG. 15. Further, by an elastic force of the 2nd date jumper 524, the 2nd date indicator 562 is positioned in a position rotated by 30 degrees in the clockwise direction from the state shown in FIG. 15. As a result, the display of the 2nd date indicator 562 is changed from "3" to "0" (or, state of "white paper"), and the display of the 1st date indicator 552 is changed from "1" to adjoining next "1". That is, under the state shown in FIG. 17, in the date window 404*g* of the dial of the timepiece with the calendar mechanism, there is displayed "1st day" in which the display of the 2nd date indicator 562 is "0" (or, state of "white paper") and the display of the 1st date indicator 552 is "1".

(1.6.6) Constitution of Calendar Collector Mechanism

Referring to FIG. 1, FIG. 14 and FIG. 19, in the movement 400, a calendar corrector mechanism contains the 1st calendar collector wheel 590, a 2nd calendar collector wheel 591, a calendar corrector wheel 592, and a calendar collector wheel spring 593. The calendar collector wheel spring 593 can be formed monolithically with the date indicator maintaining plate 502. The calendar collector wheel spring 593 is constituted so as to pressurize the calendar collector wheel 592 toward the main plate 402. The calendar collector wheel 592 is constituted so as to be capable of rocking along a guide hole provided in the main plate 402. It is constituted such that, under the state that the winging stem 410 exists in its 1st stage, the interlock hole of the 1st calendar collector wheel 590 fits with the 2nd angular part 410*f* of the winding stem 410, and the 1st calendar collector wheel 590 rotates on the basis of the rotation of the winding stem 410. It is constituted such that, under this state, if the winding stem 410 is rotated in a 1st direction, the 2nd calendar collector wheel 591 rotates on the basis of the rotation of the 1st calendar collector wheel 590. It is constituted such that, on the basis of the rotation of the 2nd calendar collector wheel 591, the calendar collector wheel 592 rocks to a position where it meshes with the 1st date indicator teeth part 516 of the 1st date indicator 552 and stops, and the calendar collector wheel 592 rotates in that collector position. It is constituted such that, if the calendar collector wheel 592 rotates in the above collector position, the1st date indicator 552 can be rotated in the counterclockwise direction. Under the state that the winding stem 410 has been pulled out to its 1st stage, if the winding stem 410 is rotated in the 1st direction, the calendar collector wheel 592 rotates and, when the date letter displayed from the date window 404*g* by the 1st date indicator 552 is changed from "1" to adjoining next "1", the 2nd calendar shift tooth 558*b* rotates the date intermediate tooth 530*a* by the fact that the 1st date indicator 552 rotates in the clockwise direction, so that the date intermediate tooth 530*e* rotates the unlocking tooth 528, thereby being capable of rotating the 2nd date indicator 562 in the clockwise direction.

(1.7) Operation of Embodiment of Timepiece with Calendar Mechanism of the Present Invention (1.7.1) Operation of Usual Hand Motion Next, it is explained about an operation of a usual hand motion of the timepiece with the calendar mechanism of the present invention. Referring to FIG. 1–FIG. 3 and FIG. 18, the battery 440 constitutes the power source of the timepiece. The crystal oscillator accommodated in the crystal oscillator unit 650 oscillates at 32,768 Hertz for instance. On the basis of the oscillation of this crystal oscillator, the oscillation part 602 built in the integrated circuit 654 outputs the reference signal, and the frequency-dividing control part 604 frequency-divides the output signal of the oscillation part 602. The motor drive part 606 outputs the motor drive signal driving the step motor to the coil block 630 on the basis of the output signal of the frequency-dividing control part 604. If the coil block 630 inputs the motor drive signal, the stator 632 is magnetized, thereby rotating the rotor 634. The rotor 634 rotates by, e.g., 180 degrees in every one second. On the basis of the rotation of the rotor 634, the second wheel & pinion 442 rotates through the rotation of the fifth wheel & pinion 441. The second wheel & pinion 442 performs one rotation in one minute. By the second hand 460 attached to the second wheel & pinion 442, "second" among time information is displayed.

The third wheel & pinion 444 rotates on the basis of the rotation of the second wheel & pinion 442. The center wheel & pinion 446 rotates on the basis of the rotation of the third wheel & pinion 444. A minute wheel may be used instead of the center wheel & pinion 446. The center wheel & pinion 446 performs one rotation in one hour. By a minute hand 462 attached to the center wheel & pinion 446, "minute" among time information is displayed. A slip mechanism is provided in the center wheel & pinion 446. By the slip mechanism, the minute hand 462 and the hour hand 464 can be rotated by rotating the winding stem 410 under a state that the second hand 460 has been stopped by setting the teeth part of the fifth wheel & pinion 442 by the train wheel setting lever 468 when performing the hand correction. The minute wheel 448 rotates on the basis of the rotation of the center wheel & pinion 446. The hour wheel 480 rotates on the basis of the rotation of the minute wheel 448. The hour wheel 480 performs one rotation in 12 hours. By the hour hand 464 attached to the hour wheel 480, "hour" among time information is displayed.

(1.7.2) Operation of Calendar Unlocking

Next, it is explained about an action of a calendar unlocking of the timepiece with the calendar mechanism of the present invention. Referring to FIG. 1–FIG. 4, FIG. 14 and FIG. 18, the date indicator driving wheel 510 rotates on the basis of the rotation of the hour wheel 480. By the fact that the date indicator driving wheel 510 rotates, the date indicator driving pawl 510*d* of the date indicator driving wheel 510 rotates the 1st date indicator 552. Referring to FIG. 15, by the fact that the date indicator driving wheel 510 rotates in the direction shown by the arrow (counterclockwise direction), the date indicator driving pawl 510*d* unlocks the 1st date indicator tooth part 516 and thereby rotates the 1st date indicator 552 in the clockwise direction by one time in one day.

When the date display by the 1st date indicator 552 and the 2nd date indicator 562 becomes "10th day" from "9th day", the date letter displayed from the date window 404*g* by the 1st date indicator 552 is changed from "9" to "0" (or, state of "white paper"). At the same time, by the fact that the 1st date indicator 552 rotates in the counterclockwise direction, the 3rd calendar shift tooth 558*c* rotates the date intermediate wheel 530 by pressing the tooth part 530*a* of the date intermediate wheel 530, and additionally the date intermediate tooth 530*e* rotates the unlocking teeth 528 to thereby rotate the 2nd date indicator 562 in the clockwise direction, so that the date letter displayed from the date window 404*g* by the 2nd date indicator 562 is changed from "0" to "1" (or, from state of "white paper" to "1").

When the date display by the 1st date indicator 552 and the 2nd date indicator 562 becomes "20th day" from "19th day", the date letter displayed from the date window 404*g* by the 1st date indicator 552 is changed from "9" to "0" (or, state of "white paper"). At the same time, by the fact that the 1st date indicator 552 rotates in the counterclockwise direction, the 4th calendar shift tooth 558*d* rotates the date intermediate wheel 530 by pressing the tooth part 530*a* of the date intermediate wheel 530, and additionally the date intermediate tooth 530*e* rotates the unlocking teeth 528 to thereby rotate the 2nd date indicator 562 in the clockwise direction, so that the date letter displayed from the date window 404*g* by the 2nd date indicator 562 is changed from "1" to "2".

When the date display by the 1st date indicator 552 and the 2nd date indicator 562 becomes "30th day" from "29th day", the date letter displayed from the date window 404*g* by the 1st date indicator 552 is changed from "9" to "0" (or, state of "white paper"). At the same time, by the fact that the 1st date indicator 552 rotates in the counterclockwise direction, the 1st calendar shift tooth 558*a* rotates the date intermediate wheel 530 by pressing the tooth part 530*a* of the date intermediate wheel 530, and additionally the date intermediate tooth 530*e* rotates the unlocking teeth 528 to thereby rotate the 2nd date indicator 562 in the clockwise direction, so that the date letter displayed from the date window 404*g* by the 2nd date indicator 562 is changed from "2" to "3".

When the date display by the 1st date indicator 552 and the 2nd date indicator 562 becomes "1st day" from "31st day", the date letter displayed from the date window 404*g* by the 1st date indicator 552 is changed from "1" to adjoining next "1". At the same time, by the fact that the 1st date indicator 552 rotates in the counterclockwise direction, the 2nd calendar shift tooth 558*b* rotates the date intermediate wheel 530 by pressing the tooth part 530*a* of the date intermediate wheel 530, and additionally the date intermediate tooth 530*e* rotates the unlocking teeth 528 to thereby rotate the 2nd date indicator 562 in the clockwise direction, so that the date letter displayed from the date window 404*g* by the 2nd date indicator 562 is changed from "3" to "0" (or, state of "white paper").

It is constituted such that, in other than "day" explained above (i.e., when it becomes from "9th day" to "10th day", when it becomes from "19th day" to "20th day", when it becomes from "29th day" to "30th day" and when it becomes from a "31st day" to "1st days"), the 2nd date indicator 562 does not rotate even if the 1st date indicator 552 rotates.

Referring to FIG. 17, if the date indicator driving wheel 510 additionally rotates in the direction shown by the arrow from the state shown in FIG. 16 and the date indicator driving pawl 510*d* rotates the 1st date indicator 552 in the direction shown by the arrow, by the elastic force of the 1st date jumper 514, the 1st date indicator 552 is positioned in the position rotated by (360/31) degrees in the counterclockwise direction from the state shown in FIG. 15. Further, by the elastic force of the 2nd date jumper 524, the 2nd date indicator 562 is positioned in the position rotated by 30 degrees in the clockwise direction from the state shown in FIG. 15. As a result, the display of the 2nd date indicator 562 is changed from "3" to "0" (or, state of "white paper") and the display of the 1st date indicator 552 is changed from "1" to adjoining next "1". That is, under the state shown in FIG. 17, in the date window 404*g* of the dial of the timepiece with the calendar mechanism, there is displayed "1st day" in which the display of the 2nd date indicator 562 is "0" (or, state of "white paper") and the display of the 1st date indicator 552 is "1".

(1.7.3) Operation of Hand Correction

Next, it is explained about an operation in a case of performing a hand correction in the timepiece with the calendar mechanism of the present invention. Referring to FIG. 1–FIG. 3 and FIG. 19, in the movement 400, when the winding stem 410 exists in its 2nd stage, the interlock angular hole of the clutch wheel 472 fits with the 1st angular part 410*b* of the winding stem 410 and, on the basis of the rotation of the winding stem 410, the clutch wheel 472 can rotate. That is, if the winding stem 410 is rotated under the state that the winding stem 410 has been pulled out to its 2nd stage, the setting wheel 449 rotates on the basis of the rotation of the clutch wheel 472. On the basis of the rotation of the clutch wheel 449, the minute wheel 448 rotates. Accordingly, when the winding stem 410 exists in its 2nd stage, by rotating the winding stem 410, it is possible to perform "hand correction". That is, when the winding stem 410 exists in its 2nd stage, by rotating the winding stem 410, it is possible, by rotating the hour wheel 480, to correct a display content of "hour" that the hour hand 464 attached to the hour wheel 480 displays and, at the same time by rotating the center wheel & pinion 446, to correct a display content of "minute" that the minute hand 462 attached to the center wheel & pinion 446 displays. When the winding stem 410 exists in its 2nd stage, by an action that the train wheel setting lever 468 sets the fifth wheel & pinion 441, the fifth wheel & pinion 441 and the second wheel & pinion 442 don't rotate during the display contents of "hour" and "minute" are being corrected, and a display content of "second" does not change.

(1.7.4) Operation of Date Correction

Next, it is explained about an operation in a case of performing a date correction in the timepiece with the calendar mechanism of the present invention. Referring to FIG. 1 and FIG. 19, in the movement 400, when the winding stem 410 exists in its 1st stage, the interlock circular hole of the 1st calendar corrector wheel 590 fits with the 2nd angular part 410*f* of the winding stem 410 and, on the basis of the rotation of the winding stem 410, the 1st calendar corrector wheel 590 can rotate. That is, under the state that the winding stem 410 is disposed in its 2nd stage, if the winding stem 410 is rotated in the 1st direction, the 2nd calendar collector wheel 591 rotates on the basis of the rotation of the 1st calendar corrector wheel 590. On the basis of the rotation of the 2nd calendar collector wheel 591, the calendar collector wheel 592 rocks to the position where it meshes with the 1st date indicator teeth part 516 of the 1st date indicator 552 and stops, and the calendar collector wheel 592 rotates in that collector position. If the calendar collector wheel 592 rotates in the above collector position, the 1st date indicator 552 can be rotated in the counterclockwise direction. Under the state that the winding stem 410 has been pulled out to its 1st stage, if the winding stem 410 is rotated in the 1st direction, the calendar collector wheel 592 rotates and, when the date letter displayed from the date window 404*g* by the 1st date indicator 552 is changed from "9" to "0" (or, state of "white paper"), by the fact that the 1st date indicator 552 rotates in the clockwise direction, the calendar shift teeth 558*a*, 558*c*, 558*d* rotate the date intermediate wheel 530 by pressing the tooth part 530*a* of the date intermediate wheel 530, so that the date intermediate tooth 530*e* rotates the unlocking tooth 528 and the 2nd date indicator 562 is rotated in the clockwise direction.

Under the state that the winding stem 410 has been pulled out to its 1st stage, if the winding stem 410 is rotated in the 1st direction, the calendar collector wheel 592 rotates and, when the date letter displayed from the date window 404*g* by the 2nd date indicator 562 is changed from "3" to "0" (or, state of "white paper") and the date letter displayed from the date window 404*g* by the 1st date indicator 552 is changed from "1" to adjoining next "1", the 2nd calendar shift tooth 558*b* rotates the date intermediate tooth 530*a* by the fact that the 1st date indicator 552 rotates in the clockwise direction, so that the date intermediate tooth 530*e* rotates the unlocking tooth 528 and the 2nd date indicator 562 is rotated in the clockwise direction. Accordingly, when the winding stem 410 exists in its 1st stage, by rotating the winding stem 410 in the 1st direction, it is possible to perform "date correction". When the winding stem 410 exists in its 1st stage, even if the winding stem 410 is rotated in a direction opposite to the 1st direction, it is impossible to perform "date correction" because the calendar collector wheel 592 does not rock to the position where it meshes with the 1st date indicator teeth part 516 of the 1st date indicator 552.

(2) 2nd Embodiment

Next, a 2nd embodiment of the timepiece with the calendar mechanism of the present invention is explained. The following explanations mainly mention points that the 2nd embodiment of the timepiece with the calendar mechanism of the present invention differs from the 1st embodiment of the timepiece with the calendar mechanism of the present invention. Accordingly, as to portions about which there are no descriptions in the following, here there are applied the explanations about the 1st embodiment of the timepiece with the calendar mechanism of the present invention.

Figure 20:
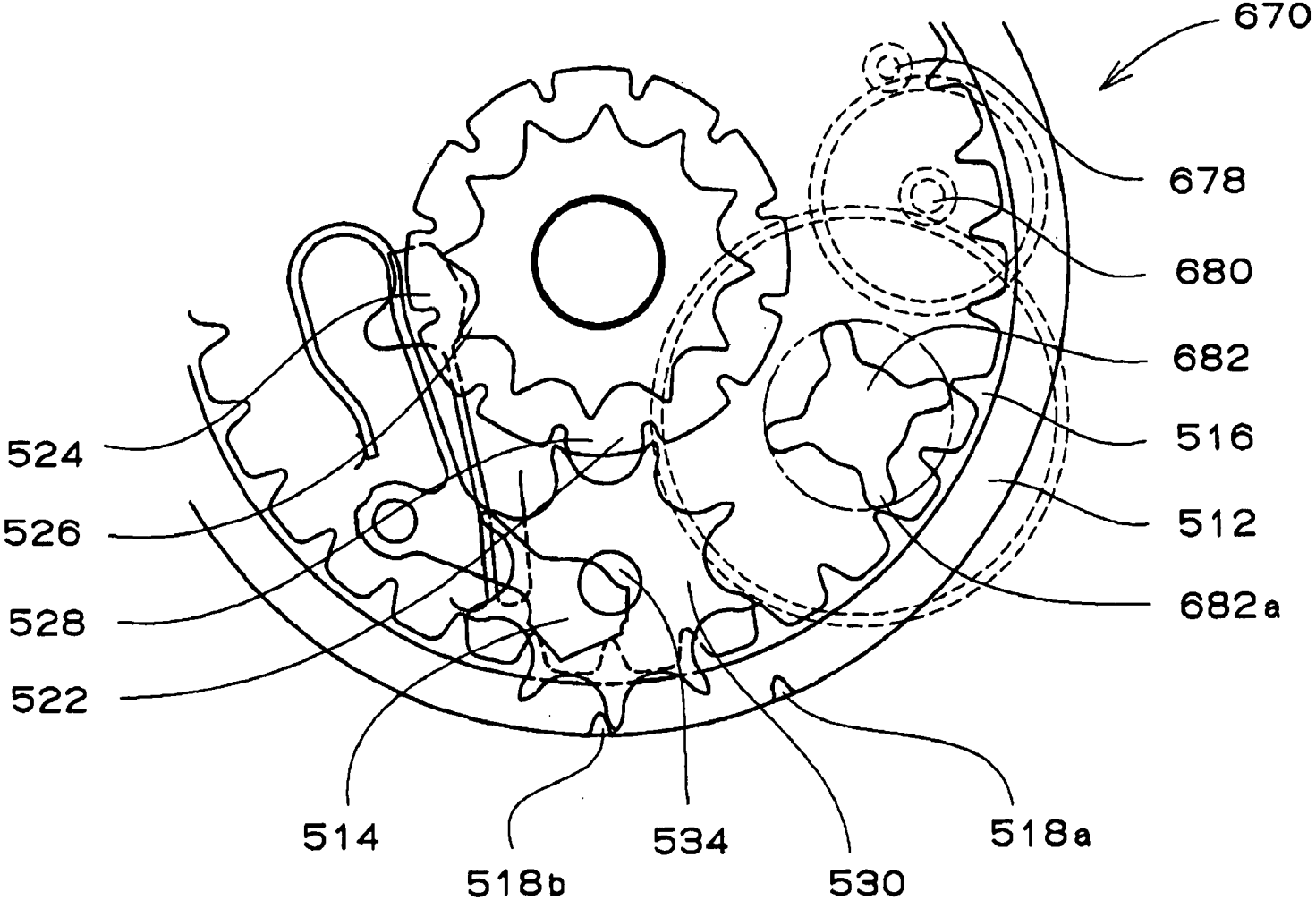
FIG. 20 is an enlarged partial plan view showing one portion of the calendar mechanism when the movement is seen from the dial side in a 2nd embodiment of the timepiece with the calendar mechanism of the present invention.
Figure 21:
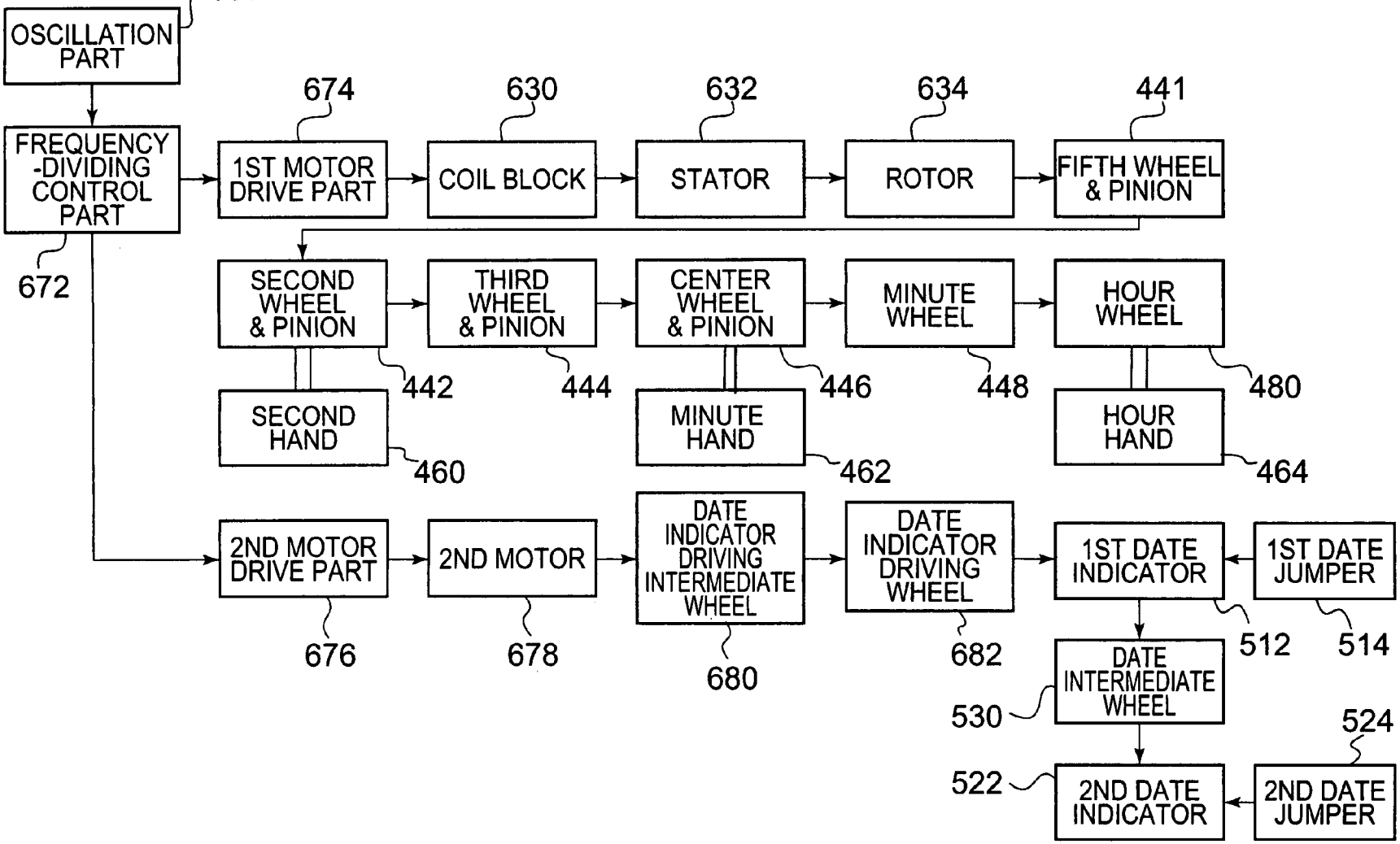
FIG. 21 is a block diagram showing the drive circuit, the front train wheel, the calendar mechanism, and the like in the 2nd embodiment of the timepiece with the calendar mechanism of the present invention.

Referring to FIG. 20 and FIG. 21, the oscillation part 602 built in an integrated circuit (not shown in the drawing) outputs the reference signal, and a frequency-dividing control part 672 frequency-divides an output signal of the oscillation part 602. A. 1st motor drive part 674 outputs, on the basis of an output signal of the frequency-dividing control part 672, a motor drive signal driving the step motor to the coil block 630. If the coil block 630 inputs the motor drive signal, the stator 632 is magnetized, thereby rotating the rotor 634. A 2nd motor drive part 676 outputs, on the basis of the output signal of the frequency-dividing control part 672, a 2nd motor drive signal driving a 2nd motor 678 to the 2nd motor 678. The 2nd motor 678 may be constituted by the step motor, may be constituted by an ultrasonic motor, or may be constituted by a motor of other type. The 2nd motor drive part 676 is built in the integrated circuit (not shown in the drawing). A date indicator driving intermediate wheel 680 rotates on the basis of an operation of the 2nd motor 678. A date indicator driving wheel 682 rotates on the basis of a rotation of the date indicator driving intermediate wheel 680. By the fact that the date indicator driving wheel 682 rotates, a date indicator driving tooth 682*a* of the date indicator driving wheel 682 rotates the 1st date indicator 512. The signal that the 2nd motor drive part 676 outputs is outputted such that the 1st date indicator 512 is rotated by for one tooth (one pitch) per one day. By the fact that the date indicator driving wheel 682 rotates, a date indicator driving wheel contact spring (not shown in the drawing) is rotated. By the fact that the date indicator driving wheel contact spring is rotated, it becomes a state that a 1st contact portion (not shown in the drawing) contacts with a reference electric potential pattern (not shown in the drawing) and a 2nd contact portion (not shown in the drawing) contacts with a contact switch pattern (not shown in the drawing) Under this state, a rotation signal of the date indicator driving wheel 682 is outputted to a date indicator driving wheel rotation signal detection part (not shown in the drawing). The date indicator driving wheel rotation signal detection part is built in the integrated circuit.

If the date indicator driving wheel rotation signal detection part inputs a rotation signal of the date indicator driving wheel 682, the date indicator driving wheel rotation signal detection part outputs a 2nd motor control signal to the 2nd motor drive part 676 in order to control an operation of the 2nd motor 678. If the 2nd motor drive part 676 inputs the 2nd motor control signal, it stops the output of the 2nd motor drive signal. By constituting like this, it is possible to control the rotation of the 1st date indicator 512.

A timepiece with a calendar mechanism of the present invention contains the 1st date indicator displaying the place of units among dates and the 2nd date indicator displaying the place of tens among dates, and its operation property is good without increasing the number of times at which the calendar mechanism must be corrected at the end of the month. Further, in a timepiece with a calendar mechanism of the present invention, since the rotation center of the 1st date indicator and the rotation center of the 2nd date indicator can be disposed in the same position, a restriction in design relating to a position where the date indicators are disposed is very small. That is, by the present invention, it is possible to realize a timepiece with a calendar mechanism, which has a degree of freedom in the position of the date display.

The timepiece with the calendar mechanism of the present invention contains the 1st date indicator displaying the place of units among dates and the 2nd date indicator displaying the place of tens among dates, and can dispose the rotation center of the 1st date indicator and the rotation center of the 2nd date indicator in the same position without increasing the number of times at which the calendar mechanism must be corrected. Accordingly, by the present invention, it is possible to realize the timepiece with the calendar mechanism, which has a degree of freedom in the position of the date display.

What is claimed is:

1. A timepiece equipped with a calendar mechanism including two date indicators, the timepiece comprising:

a first date indicator for displaying a units numeral of a date;

a first date jumper for setting a position of the first date indicator in a rotation direction;

a second date indicator for displaying a tens numeral of the date;

a second date jumper for setting a position of the second date indicator in a rotation direction; and a date intermediate wheel for undergoing rotation in accordance with rotation of the first date indicator to thereby rotate the second date indicator;

wherein the first date indicator has a first date character display surface including 31 numerals "1", "1", "2", "3", "4", "5", "6", "7", "8", "9", "0", "1", "2", "3", "4", "5", "6", "7", "8", "9", "0", "1", "2", "3", "4", "5", "6", "7", "8", "9", and "0";

wherein the second date indicator has a first date character display surface including four numerals "1", "2", "3", and "0", or a second date character display surface including three numerals "1", "2", and "3";

wherein the first date indicator has 31 first date indicator tooth portions formed as internal teeth and 4 calendar shift teeth formed as internal teeth, the first date indicator tooth portions being equally spaced apart at the same angle, the calendar shift teeth comprising a first calendar shift tooth, a second calendar shift tooth formed with a spacing of (360×2/31) degrees in a first direction relative to the first calendar shift tooth, a third calendar shift tooth formed with a spacing of (360×10/31) degrees in the first direction relative to the second calendar shift tooth, and a fourth calendar shift tooth formed with a spacing of (360×9/31) degrees in a second direction opposite to the first direction relative to the first calendar shift tooth; and wherein the date intermediate wheel undergoes rotation in accordance with rotation of the calendar shift teeth of the first date indicator to thereby rotate the second date indicator.

2. A timepiece according to claim 1; wherein a center axis of rotation of the first date indicator is coincident with a center axis of rotation of the second date indicator.

3. A timepiece according to claim 1; further comprising a dial for displaying date information; and wherein the second date character display surface is disposed closer to the dial than the first date character display surface.

4. A timepiece equipped with a calendar mechanism including two date indicators, the timepiece comprising:

a first date indicator for displaying a units numeral of the date;

a first date jumper for setting a position of the first date indicator in a rotation direction;

a second date indicator for displaying a tens numeral of the date;

a second date jumper for setting a position of the second date indicator in a rotation direction; and a date intermediate wheel for undergoing rotation in accordance with rotation of the first date indicator to thereby rotate the second date indicator;

wherein the first date indicator has a first date character display surface including 31 numerals "1", "1", "2", "3", "4", "5", "6", "7", "8", "9", "0", "1", "2", "3", "4", "5", "6", "7", "8", "9", "0", "1", "2", "3", "4", "5", "6", "7", "8", "9", and "0";

wherein the second date indicator has a first date character display surface including four numerals "1", "2", "3", and "0", or a second date character display surface including three numerals "1", "2", and "3"; and wherein the second date indicator has a disc-shaped second date character display surface provided with notches, the second date character display surface having 12 trapezoid portions formed with a spacing of (360/12) degrees, 12 notch parts formed with the spacing of (360/12) degrees, and four sets of four numerals "1", "2", "3", and "0".

5. A timepiece according to claim 4; wherein a center axis of rotation of the first date indicator is coincident with a center axis of rotation of the second date indicator.

6. A timepiece according to claim 4; further comprising a dial for displaying date information; and wherein the second date character display surface is disposed closer to the dial than the first date character display surface.

* * * * *